US010207888B2

(12) United States Patent
Hatakawa et al.

(10) Patent No.: US 10,207,888 B2
(45) Date of Patent: Feb. 19, 2019

(54) SHEET STACKING APPARATUS, SHEET PROCESSING APPARATUS, AND IMAGE FORMING SYSTEM

(71) Applicants: CANON FINETECH INC., Misato-shi, Saitama (JP); NISCA CORPORATION, Minamikoma-gun, Yamanashi (JP)

(72) Inventors: Kazunori Hatakawa, Minamikoma-gun (JP); Daiki Komiyama, Minamikoma-gun (JP); Satoru Matsuki, Minamikoma-gun (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/427,452

(22) Filed: Feb. 8, 2017

(65) Prior Publication Data

US 2017/0240372 A1 Aug. 24, 2017

(30) Foreign Application Priority Data

Feb. 19, 2016 (JP) ..... 2016-029798

(51) Int. Cl.
*B65H 31/26* (2006.01)
*B65H 31/10* (2006.01)
(Continued)

(52) U.S. Cl.
CPC ..... *B65H 31/10* (2013.01); *B65H 31/02* (2013.01); *B65H 31/26* (2013.01);
(Continued)

(58) Field of Classification Search
CPC ..... B65H 31/26; B65H 31/34; B65H 31/36; B65H 37/04
See application file for complete search history.

(56) References Cited

U.S. PATENT DOCUMENTS 5,014,977 A * 5/1991 Moore ..... B65H 31/36 271/221
6,601,846 B2 * 8/2003 Saito ..... B65H 31/34 270/58.12

(Continued)

FOREIGN PATENT DOCUMENTS

JP 2007-076920 A 3/2007
JP 2013159414 A * 8/2013

*Primary Examiner* — Luis A Gonzalez
(74) *Attorney, Agent, or Firm* — Venable LLP

(57) ABSTRACT

Provided is a sheet stacking apparatus, including: a placement portion on which a sheet is placed; a conveyance portion conveying a sheet placed on the placement portion; a regulation portion regulating a position of a sheet conveyed by the conveyance portion through contact with the sheet; and a pressing portion pressing a sheet regulated in position by the regulation portion, the pressing portion pressing a sheet regulated in position by the regulation portion at a first pressing position and a second pressing position, the second pressing position being spaced apart from the placement portion in a thickness direction of sheets placed on the placement portion by a distance which is longer than a distance between the placement portion and the first pressing position, in which an area of pressing a sheet at the first pressing position is larger than an area of pressing a sheet at the second pressing position.

17 Claims, 17 Drawing Sheets

(51) Int. Cl.

| | |
|---|---|
| ***B65H 31/02*** | (2006.01) |
| ***B65H 31/34*** | (2006.01) |
| ***B65H 31/36*** | (2006.01) |
| ***B65H 37/04*** | (2006.01) |
| ***B65H 31/30*** | (2006.01) |

(52) U.S. Cl.

CPC ..... *B65H 31/3081* (2013.01); *B65H 31/34* (2013.01); *B65H 31/36* (2013.01); *B65H 37/04* (2013.01); *B65H 2301/4212* (2013.01); *B65H 2301/4213* (2013.01); *B65H 2408/1222* (2013.01); *B65H 2511/152* (2013.01); *B65H 2511/20* (2013.01); *B65H 2801/27* (2013.01)

(56) References Cited

U.S. PATENT DOCUMENTS

| | | | | |
|---|---|---|---|---|
| 7,419,150 | B2 | 9/2008 | Kushida et al. | |
| 7,461,837 | B2 * | 12/2008 | Saito | B42C 1/12 270/58.07 |
| 7,922,165 | B2 * | 4/2011 | Kamiya | B65H 31/26 270/58.07 |
| 8,006,971 | B2 * | 8/2011 | Iguchi | B65H 31/36 270/58.07 |
| 8,393,616 | B2 * | 3/2013 | Kubota | B65H 29/26 270/58.07 |
| 8,556,257 | B2 * | 10/2013 | Mizubata | B65H 31/02 270/58.07 |
| 2017/0068202 | A1 | 3/2017 | Nakano et al. | |

* cited by examiner

SHEET STACKING APPARATUS, SHEET PROCESSING APPARATUS, AND IMAGE FORMING SYSTEM

BACKGROUND OF THE INVENTION

Field of the Invention

The present invention relates to a sheet stacking apparatus configured to stack a plurality of sheets, and a sheet processing apparatus and an image forming system, which include the sheet stacking apparatus.

Description of the Related Art

Hitherto, in a case where a plurality of sheets are placed, at least one edge of the sheets to be placed comes into contact with a position regulating surface formed in a placement portion. At this state, in the vicinity of the position regulating surface with which the sheets come into contact, a curl (warpage) is formed due to an impact of collision between the sheets to be placed and the position regulating surface. Then, a conveyance distance is deviated among the plurality of sheets, with the result that an alignment property is degraded. In view of this, an elastic film, which is arranged in the vicinity of the position regulating surface and inclined with respect to the position regulating surface, is provided to press and eliminate the curl formed in the sheets to be placed (see, for example, Japanese Patent Application Laid-Open No. 2007-76920).

In the above-mentioned pressing method which has hitherto been known, the elastic film is arranged with an inclination, and deformed within a range in which the elastic film interferes with the sheets to be placed, thereby forming a pressing surface configured to press the sheets. Thus, in a case where a small number of sheets which may more frequently cause formation of the curl are placed, the pressing surface of the elastic film is small because a small part of the elastic film interferes with the sheets. On the contrary, in a case where a large number of sheets which may less frequently cause formation of the curl are placed, the pressing surface of the elastic film is large because a large part of the elastic film interferes with the sheets. Thus, there leads to an imbalance state. Therefore, the curl formed in the case of placing a small number of sheets is not sufficiently pressed, with the result that an alignment defect occurs in the sheets to be placed.

SUMMARY OF THE INVENTION

The present invention has been made in view of the above-mentioned problem in the related art, and has an object to improve an alignment property of sheets in a sheet stacking apparatus configured to stack a plurality of sheets.

The present invention has another object of providing a sheet processing apparatus and an image forming system in which the alignment property of sheets is improved through employment of the above-mentioned sheet stacking apparatus.

According to one embodiment of the present invention, there is provided a sheet stacking apparatus, including: a placement portion on which a sheet is placed; a conveyance portion configured to convey a sheet placed on the placement portion; a regulation portion configured to regulate a position of a sheet conveyed by the conveyance portion through contact with the sheet; and a pressing portion configured to press a sheet regulated in position by the regulation portion, the pressing portion being configured to press a sheet regulated in position by the regulation portion at a first pressing position and a second pressing position, the second pressing position being spaced apart from the placement portion in a thickness direction of a sheet placed on the placement portion by a distance which is larger than a distance between the placement portion and the first pressing position, in which an area of pressing a sheet at the first pressing position is larger than an area of pressing a sheet at the second pressing position.

Further features of the present invention will become apparent from the following description of exemplary embodiments with reference to the attached drawings.

DESCRIPTION OF THE EMBODIMENTS

Now, with reference to the attached drawings, exemplary embodiments of the present invention are described in detail. Note that, in the attached drawings, like components are denoted by like reference symbols in the entire specification.

Figure 1:
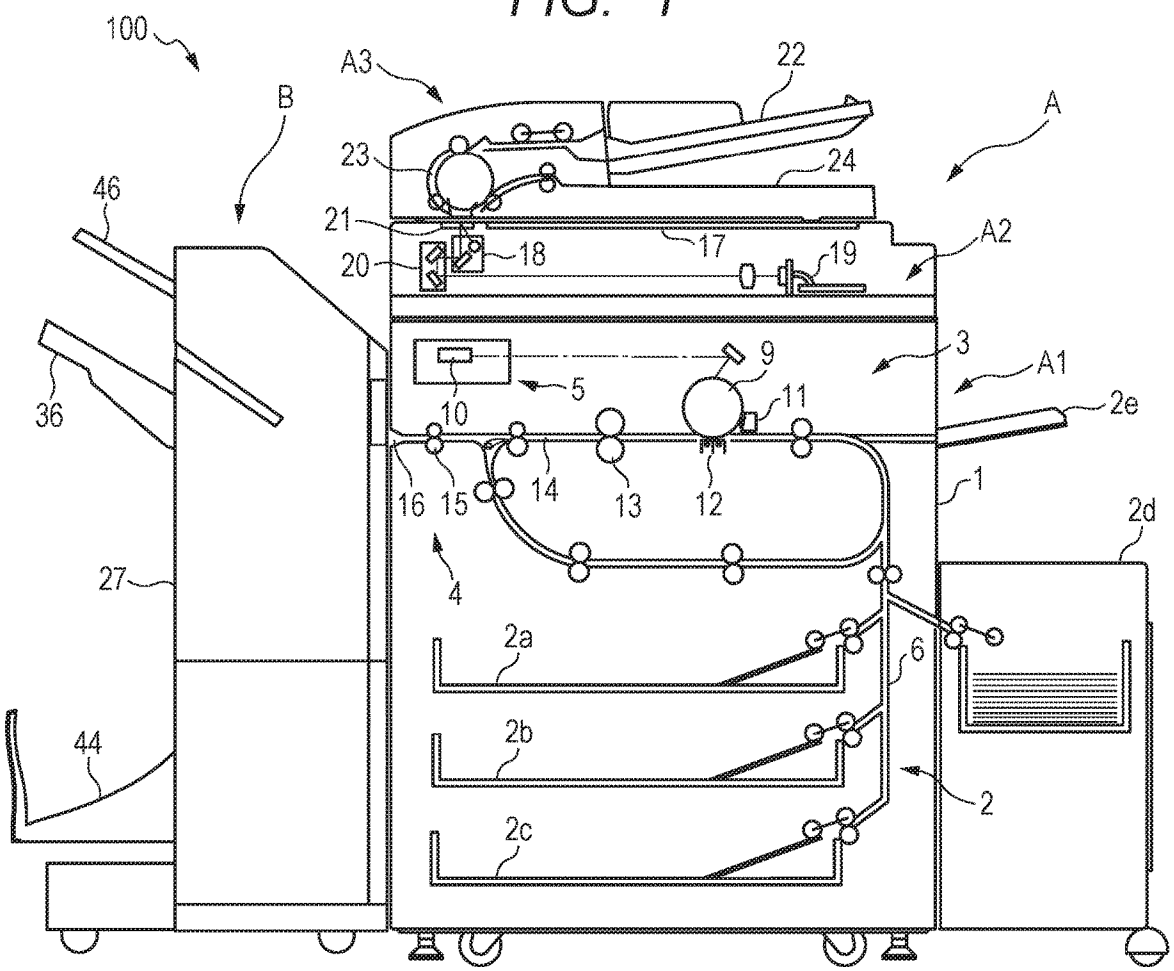
FIG. 1 is an explanatory view of the overall structure of an image forming system according to a first embodiment of the present invention.

The overall structure of an image forming system including a sheet stacking apparatus of the present invention is schematically illustrated in FIG. 1. As illustrated in FIG. 1, an image forming system 100 includes an image forming apparatus (image forming unit) A and a sheet post-processing apparatus B juxtaposed to the image forming apparatus A. The image forming apparatus A includes an image forming unit A1, a scanner unit A2, and a feeder unit A3. In an apparatus housing 1, the image forming unit A1 includes a sheet feeding portion 2, an image forming portion 3, a sheet discharge portion 4, and a data processing portion 5.

The sheet feeding portion 2 includes a plurality of cassette mechanisms 2*a*, 2*b*, and 2*c* configured to receive sheets of different sizes to be subjected to image formation, respectively, and sends out sheets having a size designated by a main body control unit (not shown) to a sheet feeding passage 6. The cassette mechanisms 2*a*, 2*b*, and 2*c* are removably placed in the sheet feeding portion 2, and each cassette mechanism includes a separating mechanism configured to separate sheets in the cassette mechanism into individual sheets and a sheet feeding mechanism configured to send out the sheets. On the sheet feeding passage 6, there are provided conveyance rollers configured to feed sheets, which are supplied from the respective cassette mechanisms 2*a*, 2*b*, and 2*c*, to downstream, and a registration roller pair arranged at an end portion of the passage and configured to align leading edges of the sheets.

A large capacity cassette 2*d* and a manual feed tray 2*e* are connected to the sheet feeding passage 6. The large capacity cassette 2*d* is an optional unit configured to receive sheets having a size which is consumed in large amounts. The manual feed tray 2*e* is configured to enable supply of special sheets, such as thick sheets, coated sheets, or film sheets, which are difficult to be separated and fed.

The image forming portion 3 is constructed by, for example, an electrostatic printing mechanism, and includes a photosensitive drum 9 to be rotated, and a light emitting unit 10 configured to emit an optical beam, a developing unit 11, and a cleaner (not shown), which are arranged at the periphery of the photosensitive drum 9. The image forming portion 3 illustrated in FIG. 1 has a monochromatic printing mechanism. A latent image is optically formed on the photosensitive drum 9 by the light emitting unit 10, and the developing unit 11 causes toner ink to adhere on the latent image.

A sheet is fed from the sheet feeding passage 6 to the image forming portion 3 at a timing of forming an image on the photosensitive drum 9, and the image is transferred onto the sheet by a transfer charger 12. The image is fixed on the sheet by fixing rollers 13 arranged on a sheet discharge passage 14. On the sheet discharge passage 14, there are arranged a sheet discharge roller 15 and a sheet discharge port 16 to convey the sheet having the image formed thereon to the sheet post-processing apparatus B described later.

The scanner unit A2 includes a platen 17 on which an image original is to be placed, a carriage 18 configured to reciprocate along the platen 17, a photoelectric conversion unit 19, and a reduction optical system 20 configured to guide light, which is radiated from the carriage 18 and reflected from the original placed on the platen 17, to the photoelectric conversion unit 19. The photoelectric conversion unit 19 is configured to photoelectrically convert optical output from the reduction optical system 20 to image data and to output the image data to the image forming portion 3 as an electric signal.

Further, the scanner unit A2 includes a running platen 21 configured to read a sheet fed from the feeder unit A3. The feeder unit A3 includes a sheet feeding tray 22, a sheet feeding passage 23 configured to guide the sheet fed from the sheet feeding tray 22 to the running platen 21, and a sheet discharge tray 24 configured to receive the original having passed on the running platen 21. The original fed from the sheet feeding tray 22 is read by the carriage 18 and the reduction optical system 20 when passing on the running platen 21.

Figure 2:
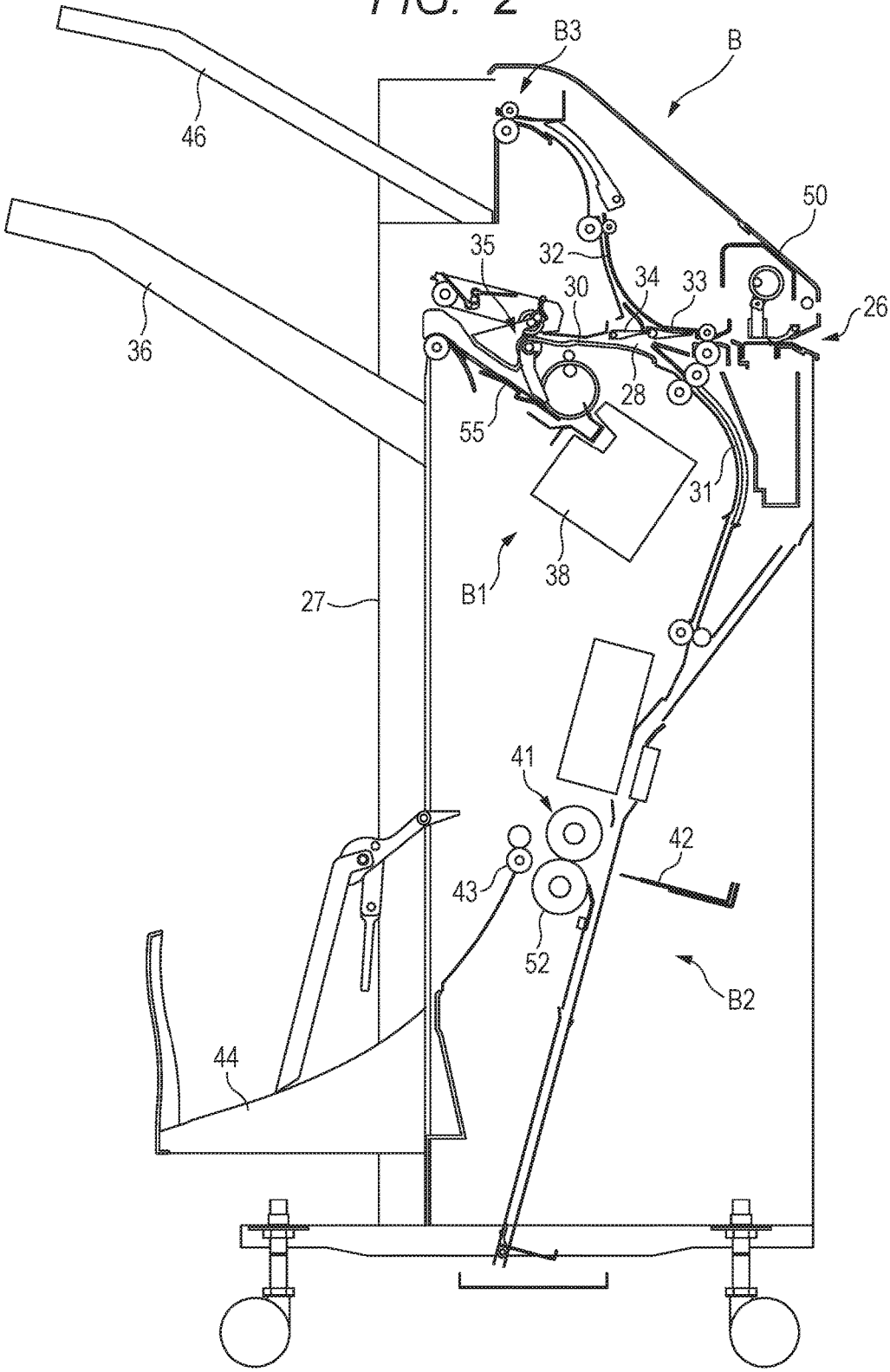
FIG. 2 is an explanatory view of the overall structure of a post-processing apparatus in the image forming system of FIG. 1.

FIG. 2 is an illustration of a configuration of the sheet post-processing apparatus B configured to perform post-processing on a sheet fed from the image forming apparatus A, on which an image is formed. The sheet post-processing apparatus B includes an apparatus housing 27 having a carry-in port 26 configured to introduce the sheet from the image forming apparatus A. The apparatus housing 27 is arranged at a position corresponding to the apparatus housing 1 of the image forming apparatus A so that the carry-in port 26 communicates with the sheet discharge port 16 of the image forming apparatus A.

The sheet post-processing apparatus B includes a sheet carry-in passage 28 configured to convey a sheet introduced from the carry-in port 26, a first sheet discharge path 30, a second sheet discharge path 31, and a third sheet discharge path 32, which branch out from the sheet carry-in passage 28, a first path-switching unit 33, and a second path-switching unit 34. Each of the first and second path-switching units 33 and 34 includes a flapper guide configured to change a direction of conveyance of a sheet conveyed on the sheet carry-in passage 28.

The first path-switching unit 33 is configured to be switched by a driving unit (not shown) into a mode of guiding a sheet from the carry-in port 26 to the third sheet discharge path 32 and a mode of guiding the sheet to a direction toward the first sheet discharge path 30 or the second sheet discharge path 31. The first sheet discharge path 30 and the second sheet discharge path 31 are arranged to communicate with each other so as to enable switch-back conveyance of reversing the conveyance direction of a sheet which has once been introduced to the first sheet discharge path 30 and introducing the sheet to the second sheet discharge path 31.

The second path-switching unit 34 is arranged on downstream of the first path-switching unit 33. The second path-switching unit 34 is similarly configured to be switched by a driving unit (not shown) into a mode of introducing a sheet which has passed under the first path-switching unit 33 to the first sheet discharge path 30 and a switch-back conveyance mode of causing a sheet which has once been introduced to the first sheet discharge path 30 to be further introduced to the third sheet discharge path 32.

The sheet post-processing apparatus B includes a first processing portion B1, a second processing portion B2, and a third processing portion B3, which perform different post-processing schemes, respectively. Further, a punching unit 50 configured to form a punch hole in a fed sheet is arranged on the sheet carry-in passage 28.

The first processing portion B1 is a binding processing portion configured to stack, align, and bind a plurality of sheets conveyed from a sheet discharge port 35 at a downstream end of the first sheet discharge path 30, and to discharge the sheets onto a stack tray 36 arranged outside the apparatus housing 27. As described later, the first processing portion B1 includes a sheet stacking apparatus 37 according to the present invention, which is configured to stack a plurality of sheets to be fed, and a binding processing unit 38 configured to bind a stacked bundle of sheets. A discharge roller pair 39 configured to discharge sheets through the sheet discharge port 35 is arranged at the downstream end of the first sheet discharge path 30.

The second processing portion B2 is configured to bundle a plurality of sheets conveyed through the switch-back conveyance from the second sheet discharge path 31 to form a bundle of sheets, bind the bundle of sheets at a central portion, and then fold the bundle of sheets. In folding processing, the bundle of sheets is arranged so that its folding position is located at a nip portion of a pair of folding rolls 41 brought into pressure contact with each other. Then, a folding blade 42 is inserted from an opposite side, and the pair of folding rolls 41 is rotated to fold the bundle of sheets. The folded bundle of sheets is discharged by discharge rollers 43 to a stack tray 44 arranged outside the apparatus housing 27.

The third processing portion B3 is configured to perform jog-sorting to sort sheets conveyed from the third sheet discharge path 32 into a group in which sheets are stacked with a predetermined amount of offset in a direction intersecting the conveyance direction (in this embodiment, direction perpendicular to the conveyance direction), and a group in which sheets are stacked without offset. The sheets subjected to the jog-sorting are discharged to a stack tray 46 arranged outside the apparatus housing 27, and offset bundles of sheets and bundles of sheets having no offset are stacked on top of each other.

Figure 3:
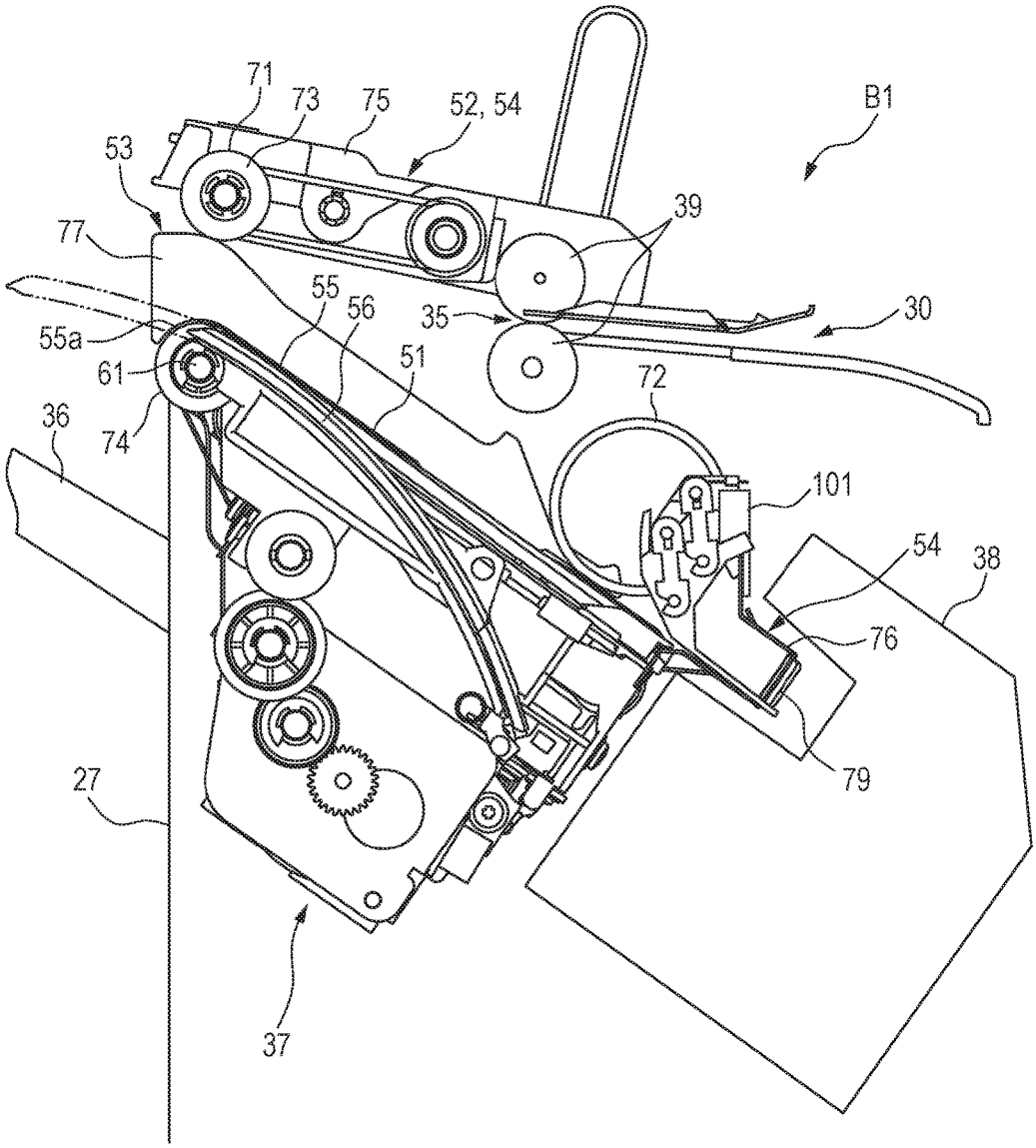
FIG. 3 is a side sectional view of the vicinity of a binding processing unit of the post-processing apparatus of FIG. 2.

The overall structure of the first processing portion B1 is schematically illustrated in FIG. 3. As described above, the first processing portion B1 includes the sheet stacking apparatus 37 configured to stack and align sheets from the sheet discharge port 35, and then discharge the bound sheets onto the stack tray 36, and the binding processing unit 38 configured to bind the bundle of sheets stacked and aligned by the sheet stacking apparatus 37. The binding processing unit 38 illustrated in FIG. 3 is a stapler apparatus configured to drive a staple into the bundle of sheets to bind the bundle of sheets. A stapleless binding apparatus configured to perform binding processing on a bundle of sheets without a staple may also be used as the binding processing unit 38 instead of the stapler apparatus.

The sheet stacking apparatus 37 includes a processing tray 51 arranged on downstream of the sheet discharge port 35 and spaced downwardly by a predetermined distance from the sheet discharge port 35. The sheet stacking apparatus 37 includes a sheet carry-in mechanism 52 configured to convey a sheet to be subjected to binding processing, which is discharged from the sheet discharge port 35 to the processing tray 51, to a back side of the processing tray 51, that is, to an opposite side to a direction of carry-out to the stack tray 36, a sheet alignment mechanism 53 configured to stack a plurality of sheets on the processing tray 51 in a bundle form and align the sheets, and a sheet carry-out mechanism 54 configured to convey the bound sheets to the stack tray 36.

Figure 4:
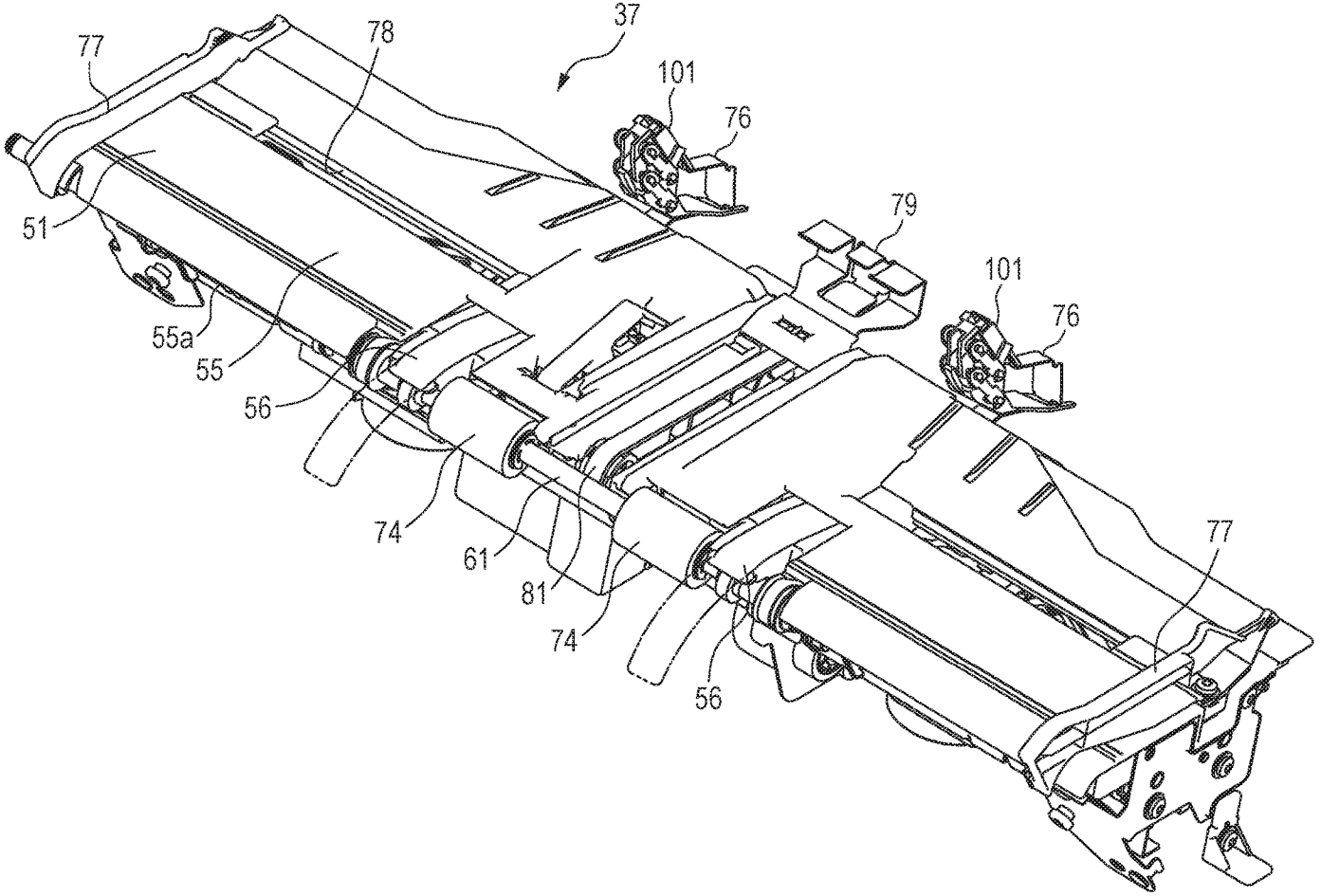
FIG. 4 is an overall perspective view of a sheet stacking apparatus according to the first embodiment of the present invention.

As illustrated in FIG. 4, the processing tray 51 has, on its upper surface, a substantially flat sheet placing surface 55 configured to at least partially support a sheet along a carry-out direction of the sheet as a placement portion for placing a sheet. The sheet placing surface 55 is inclined downward with a relatively large angle of about 40° from downstream toward upstream in the carry-out direction.

The processing tray 51 includes a pair of right and left auxiliary support members 56 which are protrudable and retractable with respect to the downstream of a downstream edge 55*a* of the sheet placing surface 55 and toward a position above the stack tray 36. Each of the auxiliary support members 56 is formed of an elongated tabular member, and has an upper surface, which is gradually curved and projected upward along the carry-out direction. Each of the auxiliary support members 56 is mounted to be movable in the carry-out direction and in a direction opposite to the carry-out direction by a guide fixed immediately below the processing tray 51.

In a case where the auxiliary support members 56 are protruded from the processing tray 51 in the carry-out direction, upper surfaces thereof are substantially continuous from the sheet placing surface 55, to thereby form an auxiliary sheet placing surface toward a position above the stack tray 36. Along the carry-out direction, an upstream part of a sheet discharged through the sheet discharge port 35 to the processing tray 51 is supported by the sheet placing surface 55, and a downstream part thereof is supported by the auxiliary sheet placing surface formed by the auxiliary support members 56.

The downstream part of the sheet is supported by the auxiliary sheet placing surface. Thus, the sheet can be prevented from slipping off toward an upstream of the processing tray 51, which has the sheet placing surface 55 having a relatively steep inclination. In order to further support the sheet by the auxiliary support members 56, a sufficient length in the carry-out direction is secured. Thus, the processing tray 51 can be reduced in dimension in the carry-out direction. Therefore, the sheet stacking apparatus 37 and the sheet post-processing apparatus B are reduced in size in the carry-out direction.

The sheet carry-in mechanism 52 includes a conveyance roller apparatus 71 also serving as a sheet carry-out mechanism 54, and a raking rotary member 72. The conveyance roller apparatus 71 includes two roller pairs arranged on right and left in the width direction (direction crossing a sheet conveyance direction in which the sheet is conveyed by the conveyance roller apparatus 71). Each roller pair has an upper conveyance roller 73 and a lower conveyance roller 74 with respect to the processing tray 51 located therebetween. The upper conveyance roller 73 is rotatably supported at a distal end of a vertically movable bracket 75 swingably supported above the processing tray 51, and the lower conveyance roller 74 is rotatably mounted on a support rod 61 on the lower side of the processing tray 51.

When the sheet is discharged from the sheet discharge port 35 to the processing tray 51, the vertically movable bracket 75 is turned downward to bring the upper conveyance roller 73 into contact with an upper surface of the sheet on the processing tray 51. Next, the upper conveyance roller 73 is driven to rotate in a counterclockwise direction in FIG. 3, and the lower conveyance roller 74 is driven to rotate in a clockwise direction in FIG. 3. This allows the sheet to be conveyed on the processing tray 51 in a carry-in direction, that is, in a direction opposite to the carry-out direction.

The raking rotary member 72 is formed of a ring-shaped or short cylindrical belt member rotatably arranged above the processing tray 51 on upstream in the carry-out direction. The raking rotary member 72 rotates in the counterclockwise direction in FIG. 3 while being in contact with and pressing the upper surface of the sheet being conveyed on the processing tray 51. This allows the sheet to be fed until its leading edge comes into contact with sheet trailing edge regulating surfaces of the sheet trailing edge regulating members 76 provided at an upstream end of the processing tray 51 in the carry-out direction while protecting the sheet being conveyed from curling and skewing that may occur.

The sheet alignment mechanism 53 includes a sheet edge regulating portion and a side alignment mechanism. The sheet edge regulating portion has the above-mentioned pair of sheet trailing edge regulating members 76 arranged on right and left. The sheet trailing edge regulating members 76 restrict, in the carry-in (or carry-out) direction, the position of the sheet having been conveyed from the sheet discharge port 35 to the processing tray 51 at the leading edge of the sheet in the carry-in direction (or at a trailing edge of the sheet in the carry-out direction).

The side alignment mechanism moves a sheet or a bundle of sheets on the processing tray 51 in the width direction to restrict and/or align the positions in the width direction at side edges. As illustrated in FIG. 4, the side alignment mechanism includes a pair of side alignment members 77 arranged on right and left with respect to a center of the processing tray 51 in its width direction. The side alignment members 77 are each formed of a tabular member protruding vertically upward from the sheet placing surface 55 of the processing tray 51, with their inner surfaces facing each other. The inner surface of each side alignment member 77 is engaged with the adjacent side edge in the width direction of the sheet on the processing tray 51 to restrict the position of the sheet in its width direction.

Each side alignment member 77 is integrally connected to a movable support portion (not shown) provided on a back side of the processing tray 51 through a linear slit 78 in the width direction, which is formed in the processing tray 51. Each of the movable support portions is driven by an individual drive motor through intermediation of, for example, a rack-and-pinion mechanism to reciprocate in the width direction so that the respective side alignment members 77 can be moved independently of each other in directions of becoming closer to or away from each other to be stopped at desired positions in the width direction.

In addition to the conveyance roller apparatus described above, the sheet carry-out mechanism 54 includes a sheet push-out member 79 being moved along the sheet placing surface 55 of the processing tray 51. The sheet push-out member 79 is connected to a conveyor belt of a conveyor device 81 arranged on the lower side of the processing tray 51. The conveyor device 81 is driven by a drive motor so that the conveyor belt is circumferentially moved in both directions along the carry-out direction of the sheet.

With this, the sheet push-out member 79 is movable in the both directions between an initial position near an upstream end of the processing tray 51 in the carry-out direction as illustrated in FIG. 4 and a maximum push-out position set on upstream with respect to the lower conveyance roller 74. For example, as illustrated in FIG. 4, the sheet push-out member 79 is formed of a channel-like member having a U-shaped cross-section. The sheet push-out member 79 is configured to feed out the sheet in the carry-out direction so that the trailing edge of the sheet, that is, the upstream edge of the sheet in the carry-out direction on the sheet placing surface 55 is pushed out. Further, as a part of the sheet edge regulating portion, the sheet push-out member 79 is configured to regulate a trailing edge position of the sheet at the initial position and/or at a position to which the sheet push-out member 79 is moved in the carry-out direction from the initial position.

Figure 5:
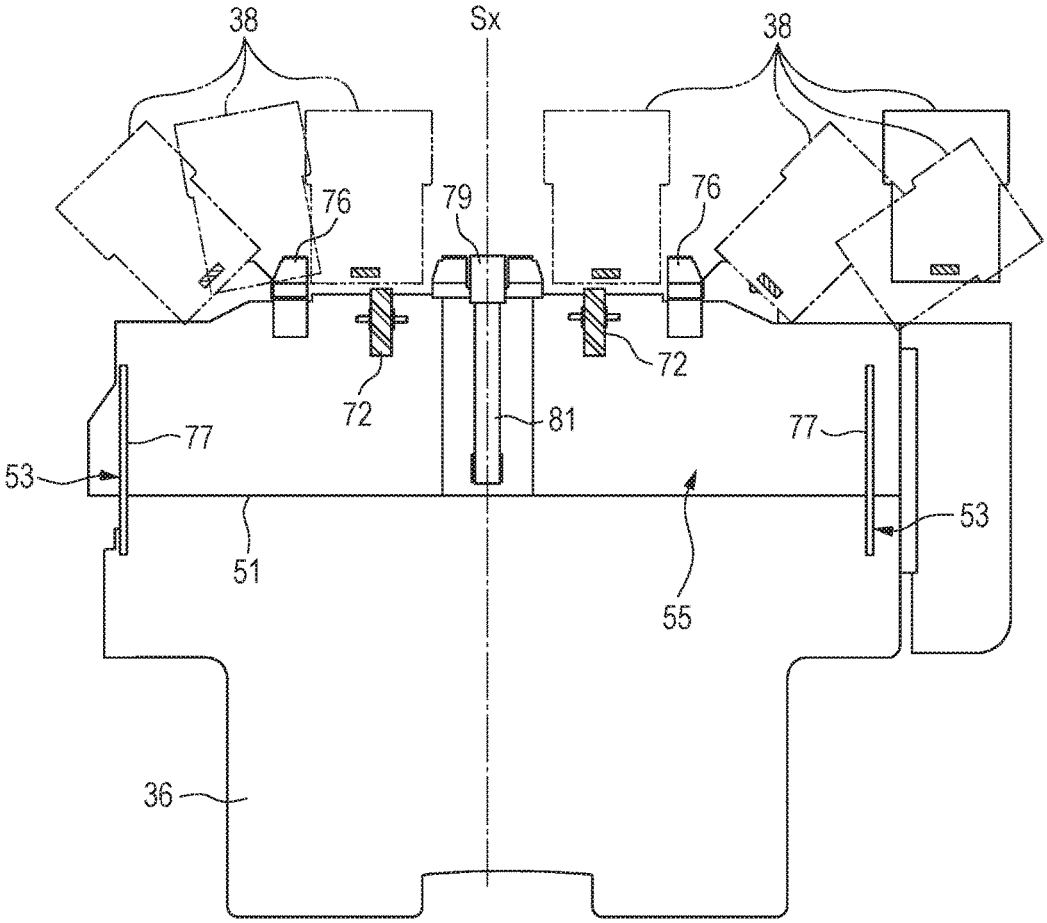
FIG. 5 is an explanatory view of a processing tray of the sheet stacking apparatus of FIG. 4, which is viewed from vertically above a sheet placing surface.
Figure 6:
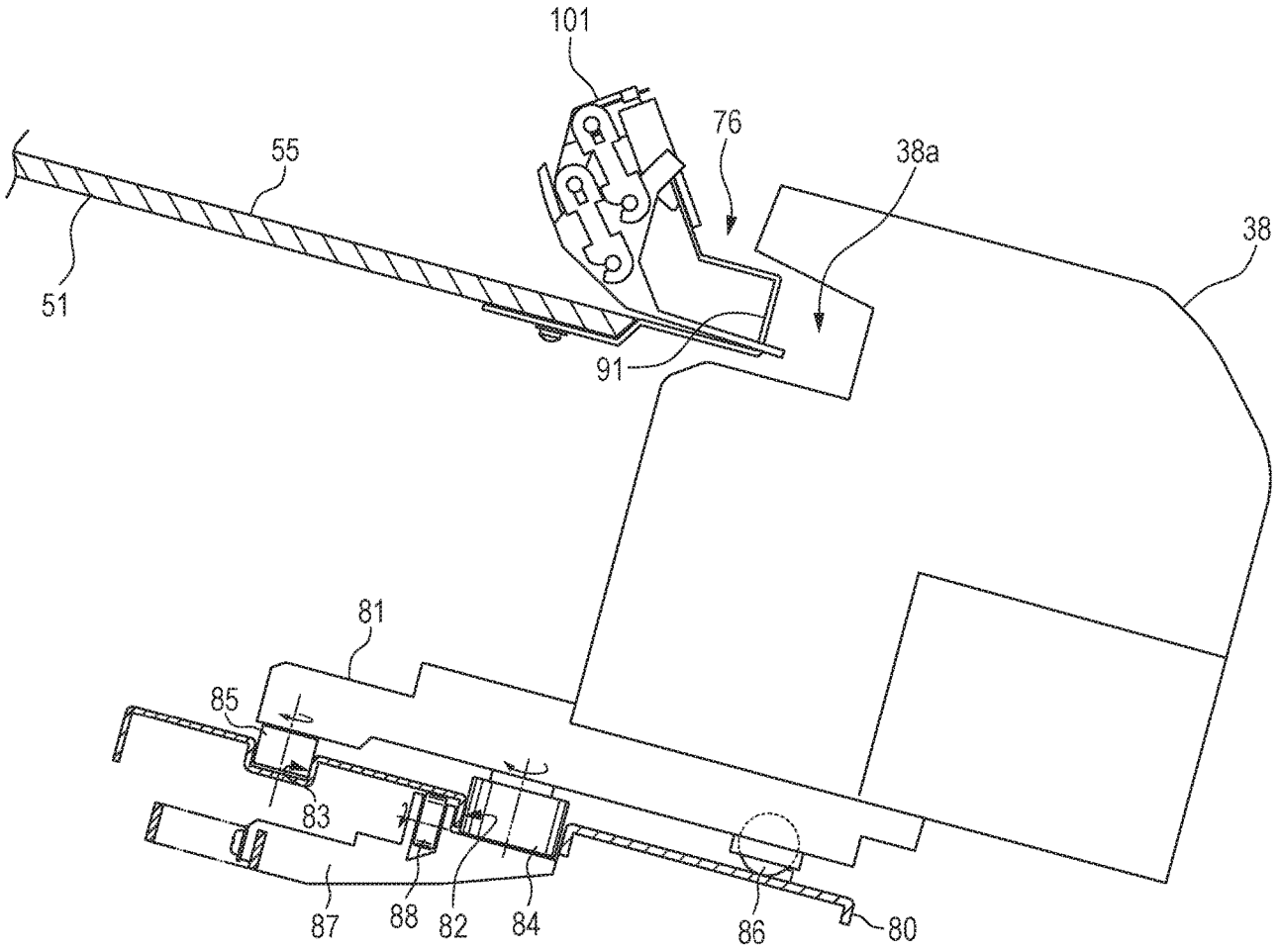
FIG. 6 is a partial sectional side view of a moving mechanism of a binding processing unit.
Figure 7:
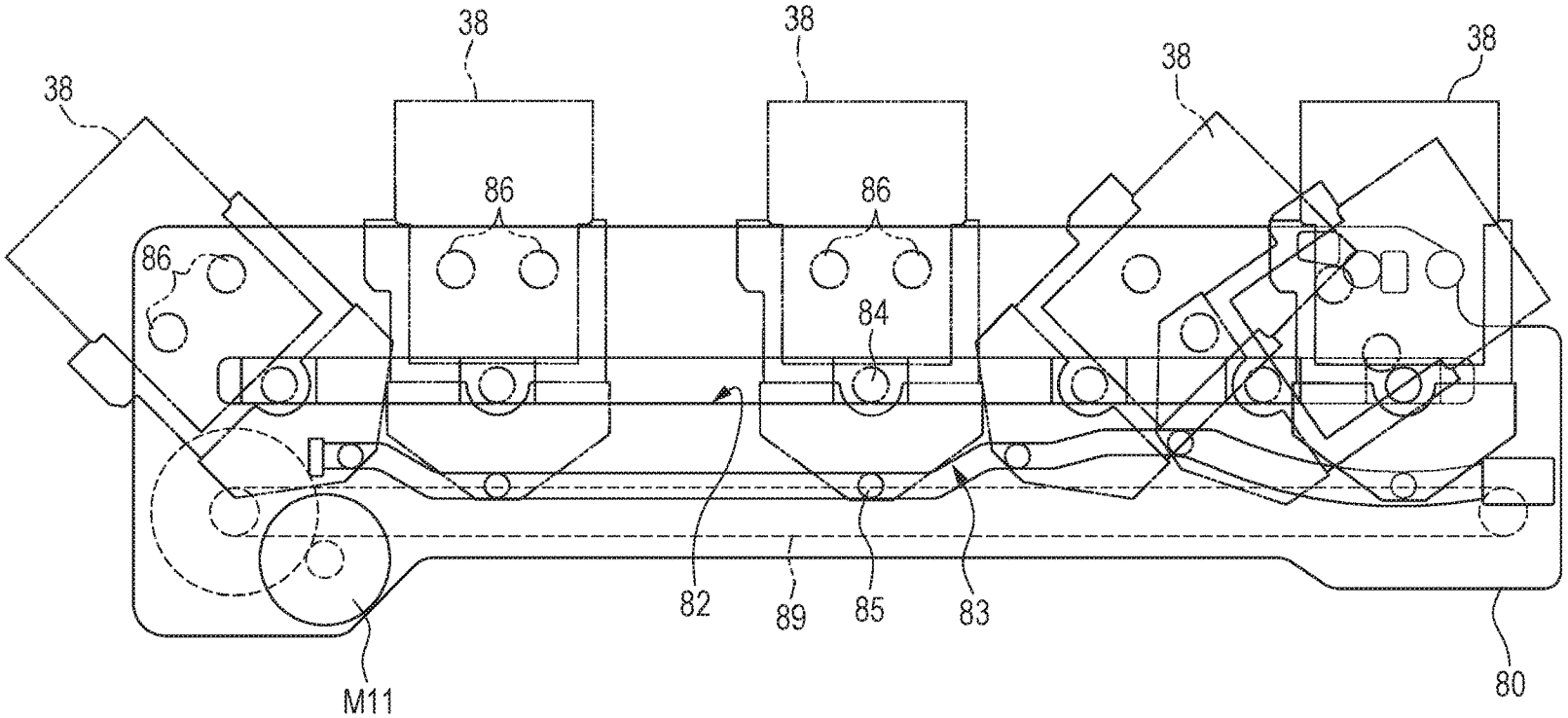
FIG. 7 is a plan view of the moving mechanism of FIG. 6.

As illustrated in FIG. 5, the binding processing unit 38 is arranged so as to be movable in right and left directions along the upstream end of the processing tray 51 in the carry-out direction, that is, in a direction perpendicular to the carry-out direction. As illustrated in FIG. 6, below a part near the upstream end of the processing tray 51, a bottom plate frame 80 extending along the right and left directions of the processing tray 51 is fixed to an apparatus housing 27 of the sheet post-processing apparatus B. In the binding processing unit 38, an upper surface of the bottom plate frame 80 is integrally fixed on a movable support base 81.

In the bottom plate frame 80, there is formed a cam slot 82 linearly extending along the right and left directions of the processing tray 51. Further, on the upper surface of the bottom plate frame 80, there is formed a guide rail 83 in a recessed manner. The guide rail 83 is formed on downstream in the carry-out direction with respect to the cam slot 82 and substantially linearly extends along the cam slot 82 while being partially curved.

On a lower surface of the movable support base 81, a first rolling roller 84 and a second rolling roller 85 are each rotatably arranged. The first rolling roller 84 serves as a cam follower member, which is fitted into the cam slot 82 and engaged with a cam surface thereof. The second rolling roller 85 is fitted into the guide rail 83 and engaged with an inner rail surface thereof. Further, on the lower surface of the movable support base 81, two spherical rollers 86 are mounted on both right and left sides, which are capable of rolling on the upper surface of the bottom plate frame 80. An auxiliary support member 87 is integrally connected to a distal end of a support shaft 84*a* of the first rolling roller 84 from the lower surface side of the bottom plate frame 80. On the auxiliary support member 87, a guide roller 88, which comes into contact with the lower surface of the bottom plate frame 80, is rollably arranged, thereby preventing the movable support base 81, that is, the binding processing unit 38 from being released from the upper surface of the bottom plate frame 80.

The movable support base 81 is fixed to a running belt 89, which is connected to a drive motor M11 arranged on the lower side of the bottom plate frame 80. The running belt 89 is wound around a pair of pulleys, which are axially supported on both right and left ends of the lower surface of the bottom plate frame 80. The running belt 89 is connected to one of the pair of pulleys so as to transmit a driving force to a rotation shaft of the drive motor M11. Thus, through forward and backward rotation of the drive motor M11, the first rolling roller 84 and the second rolling roller 85 are guided along the cam slot 82 and the guide rail 83, respectively. Therefore, the binding processing unit 38 can reciprocate at a predetermined stroke in the right and left directions along the upstream end of the processing tray 51 in the carry-out direction.

Various known shape structures may be employed in place of the above-mentioned shape structure as long as the cam slot 82 and the guide rail 83 can guide the binding processing unit 38 in a runnable manner. For example, in place of the guide rail 83, a guide rail having a projecting strip rib structure may be employed. As for the cam slot 82, there may be employed any member having a cam surface, which can guide the binding processing unit 38.

In the above-mentioned related art described in Japanese Patent Application Laid-Open No. 2007-76920, in order to align a plurality of sheets to be placed on the placement portion, at least one edge of the sheets comes into contact with a position regulating surface of the placement portion. To the placed sheets that have already been placed on the placement portion, a sheet conveying force applied to a next sheet to be fed is transmitted by a friction force generated on a surface brought into contact with the next sheet. Through transmission of a sheet conveying force, pressure is exerted in the vicinity of a contact portion between the placed sheets and the position regulating surface. In the placed sheets receiving a pressure, a curl, that is, a warpage is formed in a case where the rigidity of the sheets is insufficient.

It is known that frequency of formation of the curl differs depending on the number or quality of the placed sheets, or its environment. For example, in a case where a distance between an uppermost surface of the next sheet to be placed and the placement portion is large in a thickness (height) direction of the placed sheets, a sheet conveying force applied to the next sheet is dispersed and transmitted to a large number of the placed sheets. Thus, a pressure applied to each placed sheet is small. Therefore, the frequency of the formation of the curl in the placed sheets becomes lower. On the contrary, in a case where the distance between the uppermost surface of the next sheet to be placed and the placement portion is small, a sheet conveying force transmitted from the next sheet is dispersed to a small number of the placed sheets. Thus, a pressure applied to each placed sheet is small. Therefore, the frequency of the formation of the curl in the placed sheets becomes higher.

In the hitherto known pressing method described in Japanese Patent Application Laid-Open No. 2007-76920, an elastic film is arranged with inclination, and deformed within a range in which the elastic film interferes with the sheets to be placed, thereby forming a pressing surface configured to press the sheets. Thus, in a case where a small number of sheets which may more frequently cause formation of the curl are placed, the pressing surface of the elastic film is small because a small part of the elastic film interferes with the sheets. On the contrary, in a case where a large number of sheets which may less frequently cause formation of the curl are placed, the pressing surface of the elastic film is large because a large part of the elastic film interferes with the sheets. Thus, there leads to an imbalance state. Therefore, the curl formed in the case of placing a small number of sheets is not sufficiently pressed, with the result that an alignment defect occurs in the sheets to be placed. The sheet stacking apparatus according to the present invention has the configuration described below to solve such problem in the related art.

Figure 8:
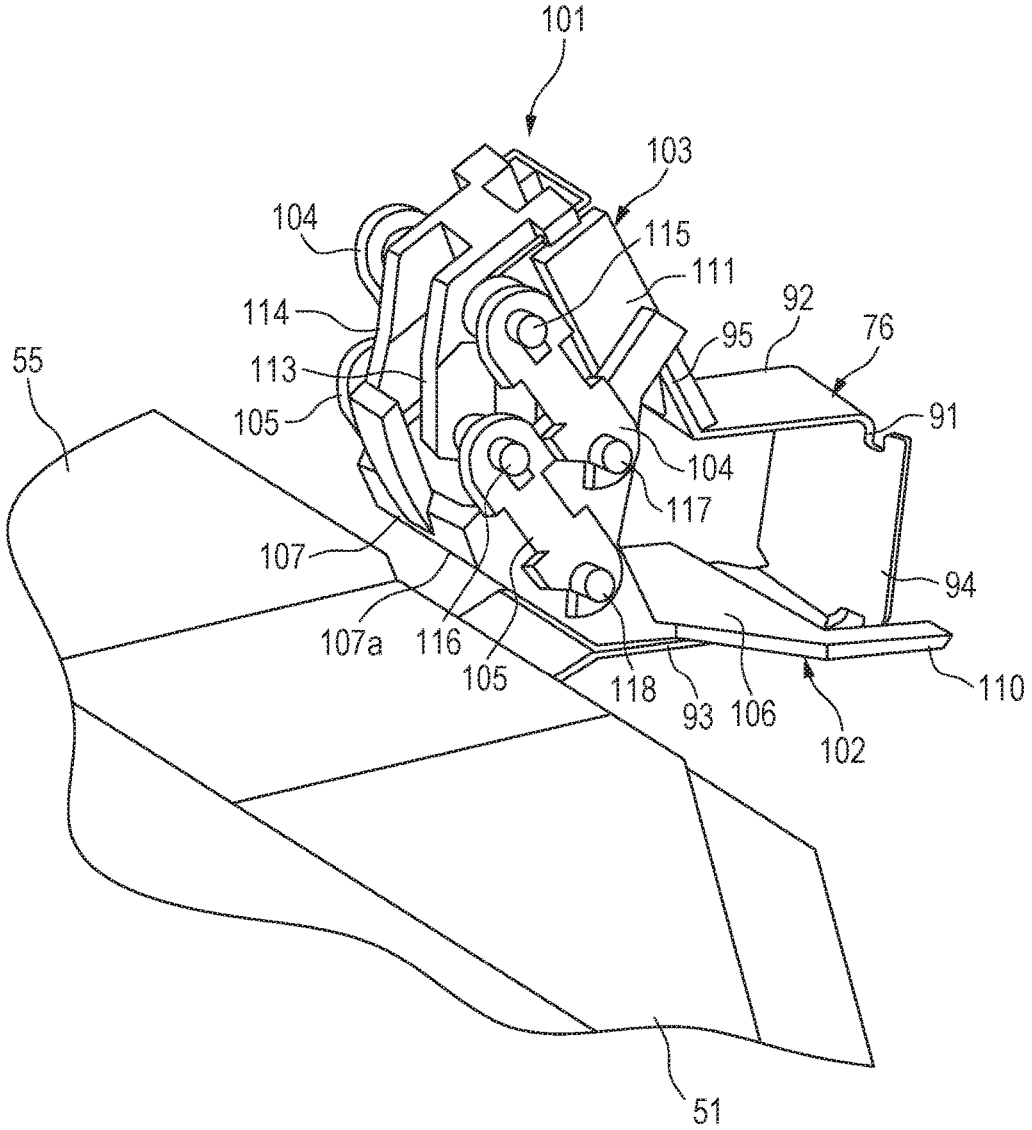
FIG. 8 is an enlarged perspective view of a sheet pressing unit of the sheet stacking apparatus of FIG. 4.

As illustrated in FIG. 4, in the sheet stacking apparatus 37, two sheet trailing edge regulating members 76 are bisymmetrically arranged along the upstream end of the processing tray 51 in the carry-out direction. A sheet pressing unit (pressing portion) 101 illustrated in FIG. 8 is integrally mounted to a distal end of each sheet trailing edge regulating member 76 on downstream in the carry-out direction.

Figure 9:
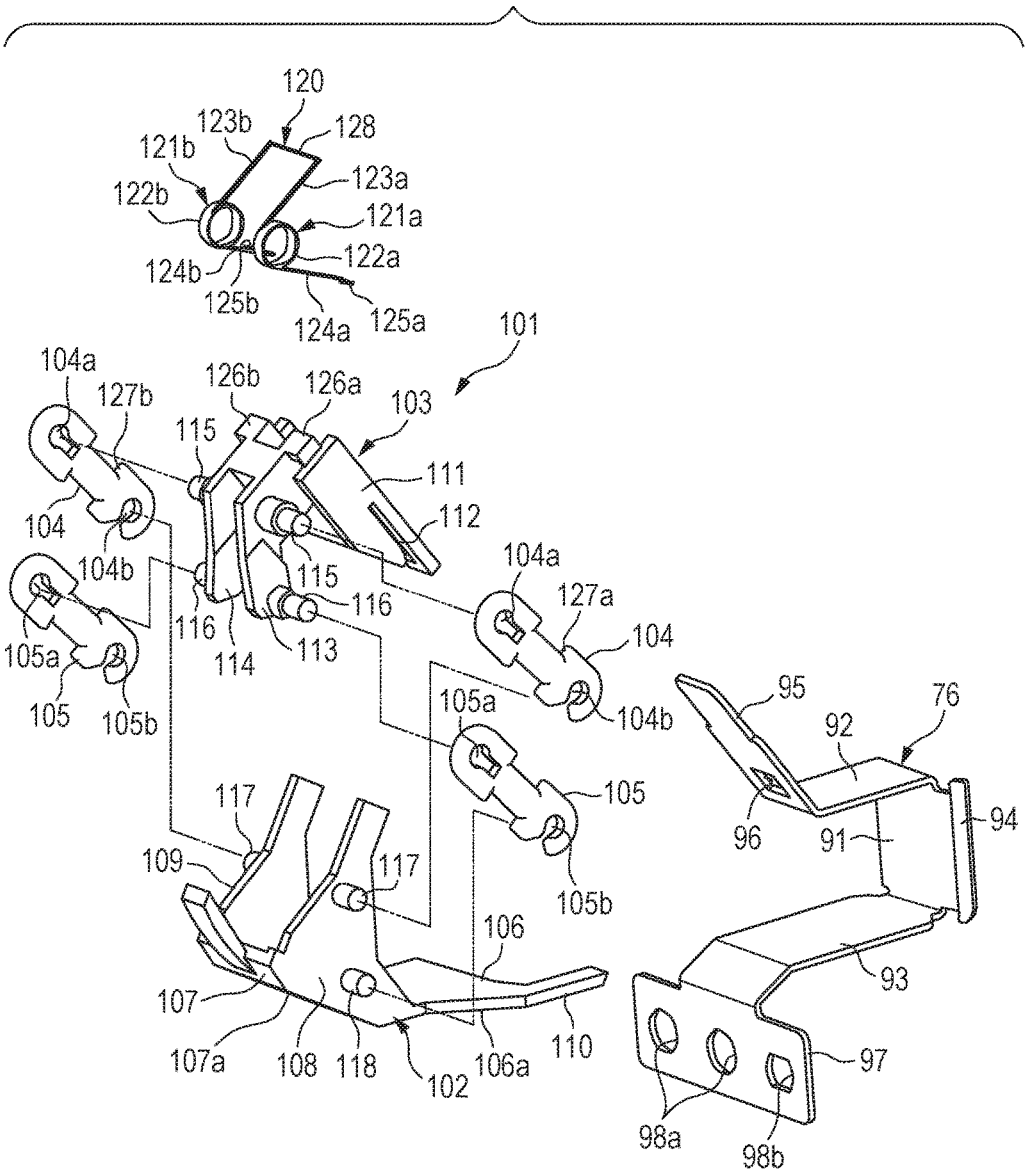
FIG. 9 is an exploded perspective view of the sheet pressing unit of FIG. 8.

The sheet trailing edge regulating member 76 is formed, for example, by subjecting a relatively thin steel plate to punching and bending process to a predetermined shape. As illustrated in FIG. 9, the sheet trailing edge regulating member 76 has a sheet edge regulating plate 91, which is positioned at the most upstream in the carry-out direction and has a substantially rectangular shape. Upper and lower flat plate portions 92 and 93 extend in parallel to each other and perpendicularly in the carry-out direction from an upper end and a lower end of the sheet edge regulating plate 91, respectively, so as to form a U-shaped cross-section together with the sheet edge regulating plate 91. Left and right side portions of the sheet edge regulating plate 91 are bent at a substantially right angle by a predetermined width to the upstream in the carry-out direction over a substantially entire length in upper and lower directions thereof, to form a guide portion 94 of the sheet pressing unit 101, which is described later.

A distance between the upper and lower flat plate portions 92 and 93 is set so as to correspond to a placement height of the sheets which can be stacked on the processing tray 51, and set so as not to be less than at least the placement height. An upper surface of the lower flat plate portion 93 is arranged to be flush with the sheet placing surface 55 so as to substantially be continuous from the sheet placing surface 55 of the processing tray 51 to the upstream in the carry-out direction.

A distal end 95 of the upper flat plate portion 92 in the carry-out direction is bent obliquely upward in the carry-out direction to construct a mounting portion of the sheet pressing unit 101. In the distal end 95, there is formed a through hole 96 through which an integrally formed fixation claw or a fixing tool such as a bolt is inserted to fix the sheet pressing unit 101. A distal end of the lower flat plate portion 93 in the carry-out direction is bent downward at a substantially right angle from the lower flat plate portion 93 to form a mounting plate 97. In the mounting plate 97, there are formed a plurality of through holes 98*a* and 98*b* through which fixing tools such as bolts, which are configured to fix the sheet trailing edge regulating members 76 to a frame part of the sheet stacking apparatus 37, and a position regulating portion configured to regulate a mounting position are to be inserted.

Two sheet pressing units 101 illustrated in FIG. 4 have substantially the same configuration and a bisymmetrical shape. Thus, one of the pressing units 101 is described below. FIG. 8 is a view for partially illustrating the sheet pressing unit 101 according to the first embodiment, which is arranged on the right side in FIG. 4. As illustrated in FIG. 8 and FIG. 9, the sheet pressing unit 101 includes the sheet pressing member 102, the fixing member 103, and a right and left pair of first link arms 104 and a right and left pair of second link arms 105 (connecting members) serving as support members configured to connect the sheet pressing member 102 to the fixing member 103 and to support the fixing member 103. Through holes 104*a* and 104*b* are formed in both ends of the first link arms 104, and through holes 105*a* and 105*b* are formed in both ends of the second link arms 105.

The sheet pressing member 102 has a pressing plate portion 106 having a substantially rectangular shape. A lower surface of the pressing plate portion 106 defines a pressing surface 106*a* configured to press an upper surface of the sheets, which are to be fed on the processing tray 51, in a thickness direction of the sheets. A guide plate portion 107 extending obliquely upward in the carry-out direction is integrally formed at a downstream end of the pressing plate portion 106 in the carry-out direction. A downwardly-oriented surface which is oriented in the carry-out direction defines a guide surface 107*a* configured to guide a leading edge of the sheet to be fed on the processing tray 51 to the sheet edge regulating plate 91.

Further, with the sheet pressing member 102, there are integrally formed mounting side plate portions 108 and 109, which bisymmetrically extend upward at a right angle from right and left sides of the guide plate portion 107 and parts of the pressing plate portion 106 continuous with the guide plate portion 107. Further, a guide bar 110 protrudes from one side portion (right side in FIG. 8 and FIG. 9) of the pressing plate portion 106 on the upstream in the carry-out direction with respect to the mounting side plate portions 108 and 109. The guide bar 110 linearly extends by a predetermined length from an extending portion, which projects sideward from the one side portion of the pressing plate portion 106, to the upstream in the carry-out direction over a rear end of the pressing plate portion 106. Meanwhile, on another sheet pressing member 102 (arranged on the left side in FIG. 4), the guide bar 110 protrudes from a side portion on the left side in FIG. 8 and FIG. 9.

The fixing member 103 has a mounting portion 111 arranged on the upstream in the carry-out direction. On a lower end and both right and left side surfaces of the mounting portion 111, a slit 112 having a narrow width is opened. The distal end 95 of the sheet trailing edge regulating member 76 is fitted into the slit 112, and the integrally formed fixation claw or the fixing tool such as a bolt is inserted through the through hole 96 from the upstream in the carry-out direction to fix the mounting portion 111. With this, the sheet pressing unit 101 can be integrally mounted to the sheet trailing edge regulating member 76.

Further, the fixing member 103 has a pair of support arms 113 and 114 bisymmetrically extending in parallel to each other from the mounting portion 111 in the carry-out direction. On outer side surfaces of the support arms 113 and 114, first support shafts 115 and second support shafts 116 protrude at predetermined bisymmetrical positions, respectively, with a predetermined distance apart from each other. Meanwhile, on outer side surfaces of the mounting side plate portions 108 and 109 of the sheet pressing member 102, first support shafts 117 and second support shafts 118 protrude at predetermined bisymmetrical positions, respectively, with a predetermined distance apart from each other.

The first link arms 104 allow the through holes 104*a* on one ends thereof to be rotatably fitted to the first support shafts 115 of the fixing member 103, and allow the through holes 104*b* on the other ends thereof to be rotatably fitted to the first support shafts 117 of the sheet pressing member 102. The second link arms 105 allow the through holes 105*a* on one ends thereof to be rotatably fitted to the second support shafts 116 of the fixing member 103, and allow the through holes 105*b* to be rotatably fitted to the second support shafts 118 of the sheet pressing member 102. The first link arms 104 and the second link arms 105 are arranged parallel to each other. Through such a four-bar link mechanism having a closed loop structure including the first link arms 104 and the second link arms 105, the sheet pressing member 102 is mounted to and supported by the fixing member 103 so as to be swingable about the first support shafts 115.

Here, distances between the first support shafts 115 and the second support shafts 116 of the fixing member 103 and distances between the first support shafts 117 and the second support shafts 118 of the sheet pressing member 102 are set to be equal, and distances between the through holes on both ends of the first link arms 104 and the second link arms 105, that is, distances between the through holes 104*a* and 104*b* and distances between the through holes 105*a* and 105*b* are set to be equal. Thus, the first link arms 104 and the second link arms 105 form a parallel link mechanism. With this, through parallel movement of the pressing surface 106*a*, the sheet pressing member 102 can be swung about the fixing member 103.

In this embodiment, the through holes 104*a* and 105*a* on the one ends of the first link arms 104 and the second link arms 105 are formed into elongated holes extending by a predetermined length in longitudinal directions, that is, in directions to the through holes 104*b* and 105*b* on the other ends, respectively. With this, for example, in a case where a pressure received by the sheet pressing member 102 from the sheets significantly fluctuates or other large outer forces are exerted, the first link arms 104 and/or the second link arms 105 are moved in the longitudinal directions within ranges of the elongated holes, thereby being capable of performing adjustment to absorb those forces.

Further, the sheet pressing unit 101 includes a spring member (elastic member) 120 illustrated in FIG. 9. In the spring member 120, a right and left pair of torsion springs 121*a* and 121*b*, for example, made of a spring steel wire material having high elastic modulus and high strength are bisymmetrically and integrally connected to each other while being separated by a connecting portion 128 located at the center.

The torsion springs 121*a* and 121*b* each have coil portions 122*a* and 122*b*, first liner portions 123*a* and 123*b*, and second linear portions 124*a* and 124*b*. The coil portions 122*a* and 122*b* have the wire material wound therearound. The first liner portions 123*a* and 123*b* and the second linear portions 124*a* and 124*b* extend from both ends of the torsion springs 121*a* and 121*b* in different directions with each other at certain acute angles. Distal ends of the first linear portions 123*a* and 123*b* are connected to both ends of the connecting portion 128 at a right angle. In this embodiment, the coil portions 122*a* and 122*b* are wound from the first linear portions 123*a* and 123*b* in the counterclockwise direction in FIG. 9. With this, the first linear portions 123*a* and 123*b* and the second linear portions 124*a* and 124*b* are urged in directions of separating from each other. Hooks 125*a* and 125*b* are formed on distal ends of the second linear portions 124*a* and 124*b*, respectively.

The mounting portion 111 of the fixing member 103 has hook pieces 126*a* and 126*b* which protrude near upper ends of right and left side surfaces thereof. In the first link arms 104 mounted to the first support shafts 115, which are close to the mounting portion 111, cutouts 127*a* and 127*b* are formed at positions, which are located in sides on the mounting portion 111 side and near ends on the sheet pressing member 102 side, respectively.

The coil portions 122*a* and 122*b* are externally fitted to the first support shafts 115 of the fixing member 103, respectively, in a relatively loose manner from right and left outer sides. The connecting portion 128 is arranged to stride across the mounting portion 111 from the upstream in the carry-out direction so that parts of the first linear portions 123*a* and 123*b* near the connecting portion 128 are engaged with lower sides of the hook pieces 126*a* and 126*b* of the right and left surfaces of the mounting portion 111, respectively. Further, the hooks 125*a* and 125*b* at the distal ends of the second linear portions 124*a* and 124*b* are hooked to the cutouts 127*a* and 127*b* of the first link arms 104, which are externally fitted to the first support shafts 115 from the outer sides of the coil portions 122*a* and 122*b*. In this manner, the spring member 120 is mounted. With this, the first link arms 104 are always urged in the clockwise direction in FIG. 9 about the first support shafts 115.

As illustrated in FIG. 8, the sheet pressing member 102 is arranged between the upper and lower flat plate portions 92 and 93 of the sheet trailing edge regulating member 76, and the sheet pressing unit 101 is mounted to the distal end 95. The sheet pressing member 102 is supported so as to be rotatable about the first support shafts 115 by the first link arms 104 in both directions between the lowermost position of FIG. 10A at which the pressing surface 106*a* is held in contact with the upper surface of the lower flat plate portion 93 and the uppermost position of FIG. 10B at which the sheet pressing member 102 comes into contact with a lower surface of the upper flat plate portion 92. At this state, as described above, the first link arms 104 and the second link arms 105 form a parallel link mechanism, and hence the pressing surface 106*a* of the sheet pressing member 102 is always kept substantially parallel to the upper surface of the lower flat plate portion 93 (and at least part of the sheet placing surface 55 continuous with the upper surface of the lower flat plate portion 93 on the upstream in the carry-out direction).

Figure 10A:
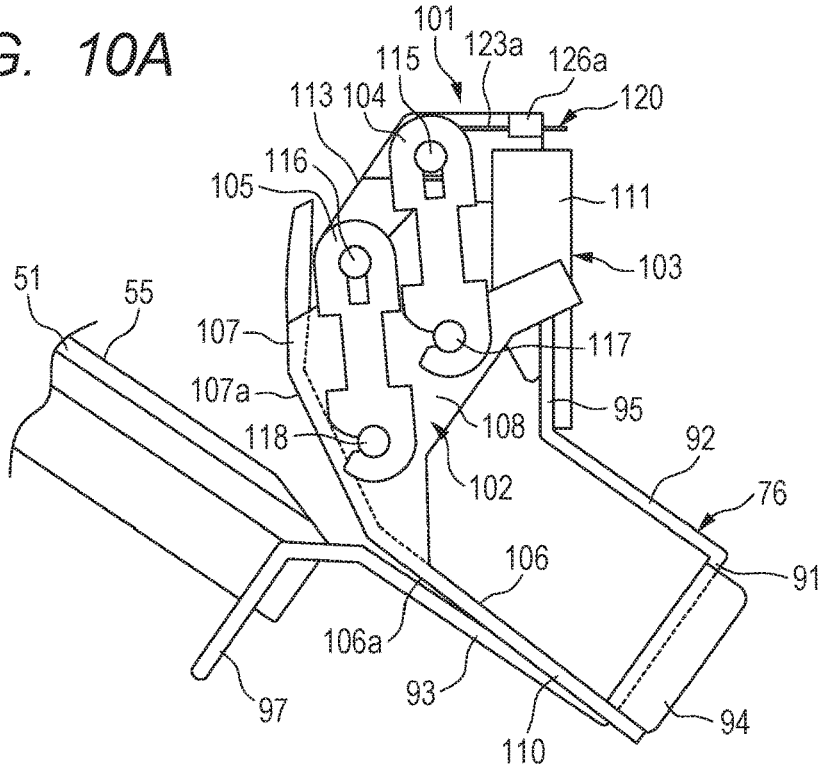
FIG. 10A is a side view of the sheet pressing unit of FIG. 8, which has a pressing member at a lowermost position.
Figure 10B:
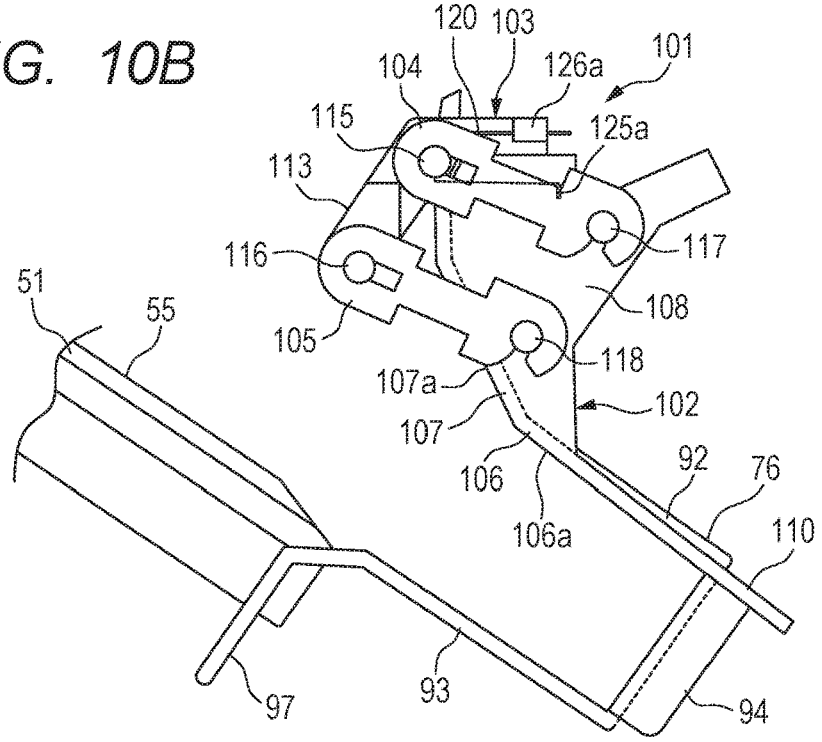
FIG. 10B is a side view of the sheet pressing unit of FIG. 8, which has the pressing member at an uppermost position.

Further, through appropriate settings of positions of the first support shafts 117 and the second support shafts 118 of the sheet pressing member 102 and positions of the first support shafts 115 and the second support shafts 116 of the fixing member 103, the sheet pressing member 102 can be moved to the upstream in the carry-out direction as ascending from the lowermost position of the FIG. 10A to the uppermost position of FIG. 10B. Therefore, as the number of sheets placed on the processing tray 51 becomes larger and a placement height of the sheets becomes larger, an area of the sheets pressed by the pressing surface 106*a* becomes smaller. Meanwhile, a pressing force applied from the pressing surface 106*a* to the upper surface of the sheets is minimum at the lowermost position of FIG. 10A, and becomes larger as the sheet pressing member 102 ascends toward the uppermost position of FIG. 10B.

Figure 11A:
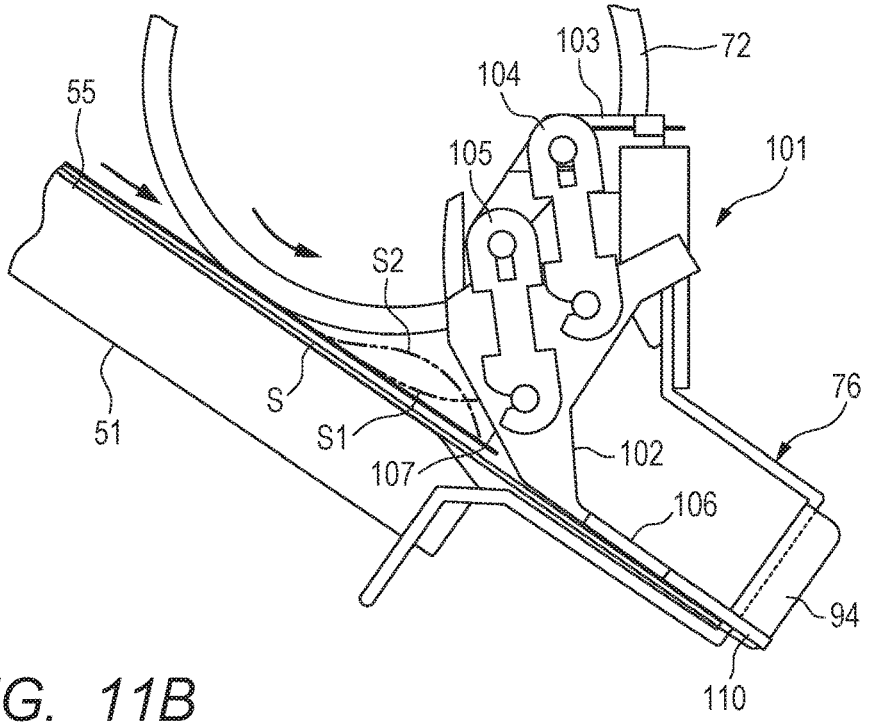
FIG. 11A is a side view of the sheet pressing unit, for illustrating a case where a small number of sheets are conveyed to the processing tray.

FIG. 11A is a view for illustrating a case where a small number of sheets have already been placed on the processing tray 51, and where a next sheet is to be fed under a state in which a placement height is small. In this case, the sheet pressing member 102 presses an upper surface of a sheet S to be fed from a position on a near side with respect to the sheet edge regulating plate 91 of the sheet trailing edge regulating member 76, that is, from a position on downstream in the carry-out direction. An area of the sheet S, which is pressed by the pressing surface 106*a*, is large, but a pressing force per unit area, which is applied to the upper surface of the sheet S, is small. Therefore, the sheet S is guided by a guide surface 107*a* of the sheet pressing member 102, held in contact with the pressing surface 106*a*, and smoothly fed to a position at which an edge thereof (trailing edge in the carry-out direction) comes into contact with the sheet edge regulating plate 91.

Figure 11B:
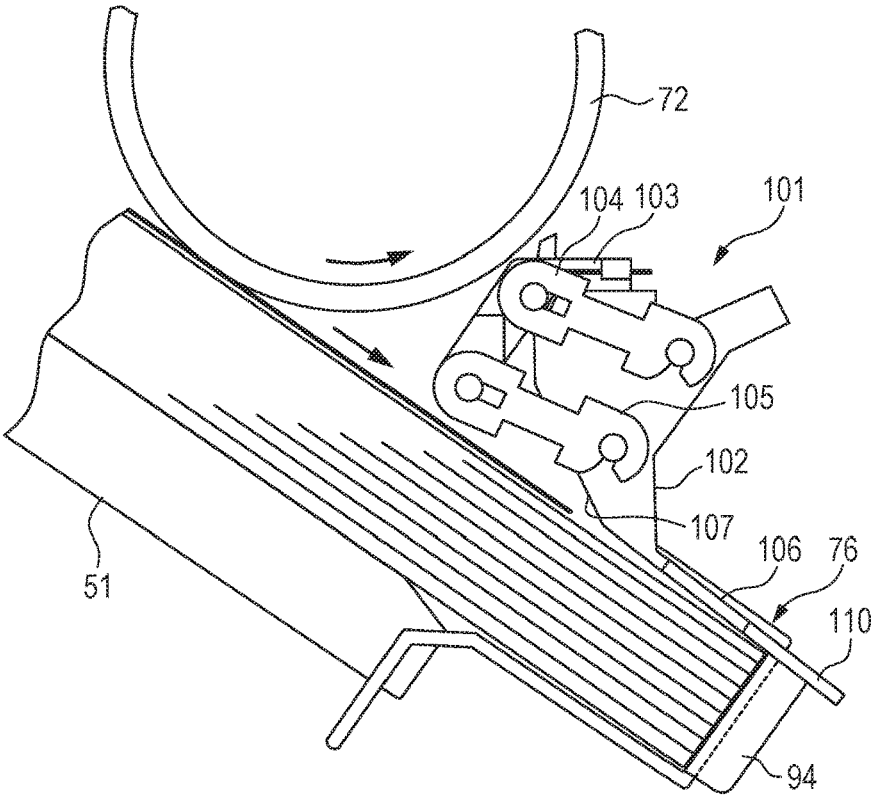
FIG. 11B is a side view of the sheet pressing unit, for illustrating a case where a large number of sheets are conveyed to the processing tray.

FIG. 11B is a view for illustrating a case where a large number of sheets have already been placed on the processing tray 51, and where a next sheet is to be fed under a state in which a placement height is large. In this case, the sheet pressing member 102 presses an upper surface of a sheet S to be fed from a position closer to the sheet edge regulating plate 91 of the sheet trailing edge regulating member 76, that is, from a position on the upstream in the carry-out direction. A pressing force per unit area, which is applied to the upper surface of the sheet S, is large, but a pressed area of the sheet S is small. Therefore, as in the case of FIG. 11A, the sheet S is guided by the guide surface 107*a*, held in contact with the pressing surface 106*a*, and smoothly fed to the position at which the edge thereof comes into contact with the sheet edge regulating plate 91.

The guide plate portion 107 of the sheet pressing member 102 is moved integrally with the pressing plate portion 106. Thus, as apparent from FIG. 11A and FIG. 11B, a height distance to the uppermost surface of the sheets on the processing tray 51 is always substantially constant irrespective of the placement height. Therefore, as indicated by the two-dot chain lines of FIG. 11A, even in a case where an edge of a sheet S1 or a sheet S2 is upwardly or downwardly warped, the warpage can be flattened by the guide surface 107*a* and the pressing surface 106*a*, to thereby be fed to a position at which the sheet S1 or the sheet S2 comes into contact with the sheet edge regulating plate 91. With this, an alignment property and consistency of the sheets stacked on the processing tray 51 can be improved.

Further, while the sheet pressing member 102 is moved from the lowermost position of FIG. 10A to the uppermost position of FIG. 10B, the guide bar 110 is arranged so as to be always moved along the guide portion 94 of the sheet edge regulating plate 91. With this, the sheet pressing member 102 is regulated from being moved to the other sheet pressing unit 101, and configured to prevent entry of the sheet between the sheet edge regulating plate 91 and the sheet pressing member 102.

In a case where the sheet pressing member 102 is displaced toward the other sheet pressing unit 101 side due to a friction between the pressing surface 106*a* and an upper surface of a sheet to be fed, the sheet is drawn inwardly between the right and left sheet pressing units 101, with the result that swellings or wrinkles are formed on the sheet. Thus, there may be a fear in that an alignment property and consistency of sheets may be degraded or that a next sheet may not be properly stacked. In this embodiment, the sheet pressing members 102 of the right and left sheet pressing units 101 are each regulated so as not to be moved toward another sheet pressing unit 101 by the guide bar 110. Thus, a plurality of sheets can always be stacked with a high alignment property and high consistency in a satisfactory and continuous manner.

In order to allow the binding processing unit 38 to perform binding processing on a bundle of sheets coming into contact with the sheet edge regulating plate 91 as described above, the sheet pressing units 101 are configured and arranged so as not to hinder movement of the binding processing unit along the trailing edge of the bundle of sheets in the carry-out direction. The binding processing unit 38 is a known stapler unit including a staple head configured to drive a staple into the bundle of sheets and an anvil member configured to bend tips of the staple. As illustrated in FIG. 6, the sheet trailing edge regulating members 76 are arranged so that a rear end part having a U-shaped cross-section in the carry-out direction is positioned in a binding space 38*a* defined by the staple head and the anvil member, which are arranged to face each other at a binding position.

The sheet pressing unit 101 is arranged at a distal end of the sheet trailing edge regulating member 76 positioned outside the binding space 38*a* on downstream in the carry-out direction. The sheet pressing member 102 is arranged so as to be always positioned in a space having a U-shaped cross-section defined by the sheet edge regulating plate 91 of the sheet trailing edge regulating member 76 and the upper and lower flat plate portions 92 and 93. Further, the guide bar 110 is formed and arranged so as to have such a dimension that a distal end thereof extending to the upstream in the carry-out direction is always positioned in the binding space 38*a* of the binding processing unit 38. Therefore, the binding processing unit 38 can be moved along a trailing edge of the bundle of sheets in the carry-out direction, which comes into contact with the sheet edge regulating plate 91, without interfering with the sheet trailing edge regulating member 76 and the sheet pressing unit 101.

Figure 12:
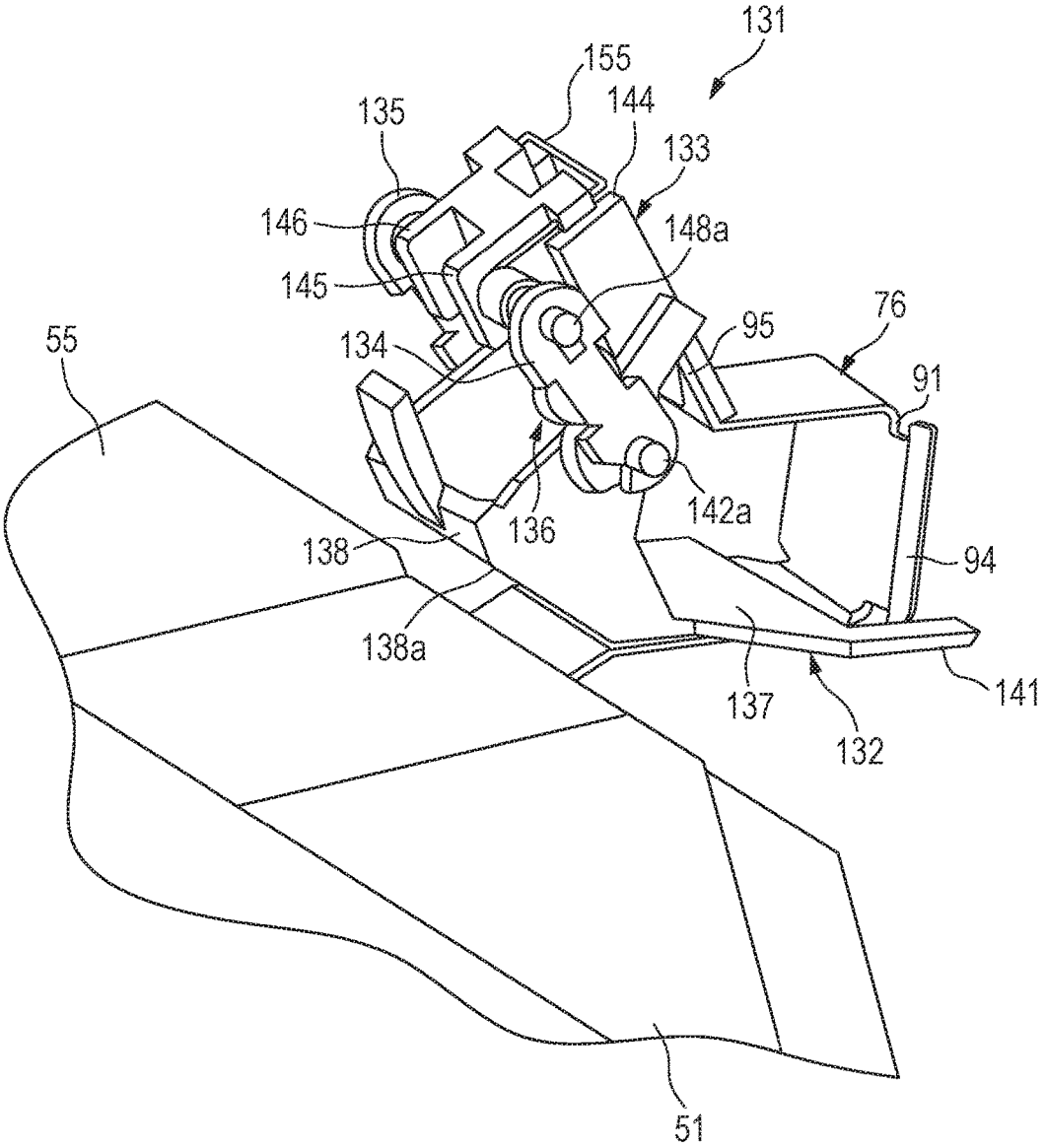
FIG. 12 is an enlarged perspective view of a sheet pressing unit according to a second embodiment of the present invention.
Figure 13:
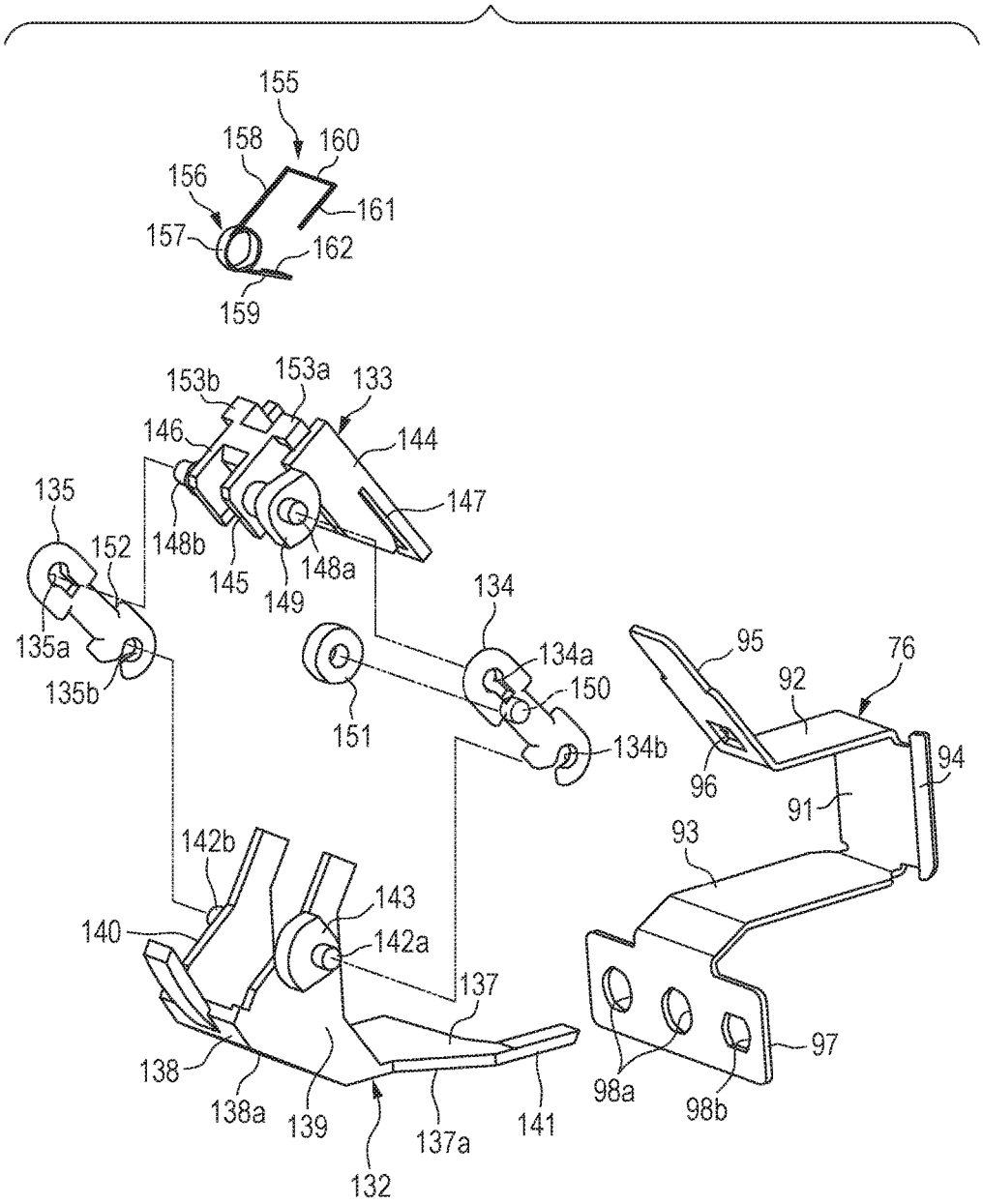
FIG. 13 is an exploded perspective view of the sheet pressing unit of FIG. 12.

FIG. 12 and FIG. 13 are illustrations of a sheet pressing unit 131 according to a second embodiment of the present invention. For each distal end of the two sheet trailing edge regulating members 76 on the carry-out direction side, which are bisymmetrically arranged along the upstream end of the processing tray 51 in the carry-out direction, the sheet pressing unit 131 is integrally and symmetrically mounted.

The sheet pressing unit 131 includes a sheet pressing member 132 and a fixing member 133, which correspond to the sheet pressing member 102 and the fixing member 103 according to the first embodiment. Further, the sheet pressing unit 131 includes link arms 134 and 135, and a gear mechanism 136 in place of the first link arms 104 and the second link arms 105 according to the first embodiment. Through holes 134*a*, 134*b*, 135*a*, and 135*b* are formed in ends of the link arms 134 and 135, respectively.

Similarly to the sheet pressing member 102 according to the first embodiment, in the sheet pressing member 132, there are integrally formed a pressing plate portion 137 having a substantially rectangular shape, a guide plate portion 138 extending obliquely upward in the carry-out direction from a downstream end of the pressing plate portion 137 in the carry-out direction, and bisymmetrical mounting side plate portions 139 and 140. A lower surface of the pressing plate portion 137 defines a pressing surface 137*a* configured to press an upper surface of sheets on the processing tray 51, and a downwardly-oriented inclined surface of the guide plate portion 138 defines a guide surface 138*a* configured to guide an edge of a sheet on the processing tray 51 to the sheet edge regulating plate 91. At a side portion of one side (right side in FIG. 12 and FIG. 13) on the upstream in the carry-out direction with respect to the mounting side plate portions 139 and 140 of the pressing plate portion 137, a guide bar 141 linearly extends by a predetermined length to the upstream in the carry-out direction over an rear end of the pressing plate portion 137.

Similarly to the first embodiment, the mounting side plate portions 139 and 140 extend upward at a right angle from right and left side portions of the guide plate portion 138 and parts of the pressing plate portion 137, which is continuous with the guide plate portion 138. From outer side surfaces of the mounting side plate portions 139 and 140, a support shaft 142*a* and a support shaft 142*b*, which correspond to the first support shafts 117 according to the first embodiment, protrude at predetermined bisymmetrical positions, respectively. Further, on mounting side plate portion 139 (right side in FIG. 12 and FIG. 13), there is integrally formed or fixed a first sector gear 143 constructing a part of the gear mechanism 136. The first sector gear 143 is on a base end of the support shaft 142*a* and is coaxial with the support shaft 142*a*.

The fixing member 133 has a mounting portion 144 and a bisymmetrical pair of support arms 145 and 146, which correspond to the mounting portion 111 and the support arms 113 and 114 according to the first embodiment. In the mounting portion 144, a slit 147, which is opened to a lower end and both right and left side surfaces of the mounting portion 144, is formed so that the distal end 95 of the sheet trailing edge regulating member 76 is fitted into the slit 147 to integrally mount the sheet pressing unit 131 to the sheet trailing edge regulating member 76.

The support arms 145 and 146 extending from the mounting portion 144 in the carry-out direction in parallel to each other are formed to be shorter than the support arms 113 and 114 according to the first embodiment. From outer side surfaces of the support arms 145 and 146, a support shaft 148*a* and a support shaft 148*b*, which correspond to the first support shafts 115 according to the first embodiment, protrude at predetermined bisymmetrical positions, respectively. Further, on the support arm 145 on the same side as the mounting side plate portion 139 (right side in FIG. 12 and FIG. 13), there is integrally formed or fixed a second sector gear 149 constructing a part of the gear mechanism 136. The second sector gear 149 is on a base end of the support shaft 148*a* and is coaxial with the support shaft 148*a*.

In the link arm 134 on the same side as the mounting side plate portion 139 (right side in FIG. 12 and FIG. 13), a support shaft 150 protrudes on an inner side surface of the link arm 134, that is, a side surface of the link arm 134 on the mounting side plate portion 139 side, at an intermediate position between the through holes 134*a* and 134*b*. An intermediate gear 151 constructing a part of the gear mechanism 136 is rotatably mounted to the support shaft 150. On the link arm 135 on the opposite side, a cutout 152 is formed in a side on the mounting portion 144 side. Further, hook pieces 153*a* and 153*b* protrude from the mounting portion 144 of the fixing member 133 near upper ends of right and left side surfaces of the mounting portion 144, respectively.

Further, the sheet pressing unit 131 includes a spring member 155 illustrated in FIG. 13. Similarly to the first embodiment, the spring member 155 has one torsion spring 156 made of, for example, a spring steel wire material having high elastic modulus and high strength. The torsion spring 156 has a coil portion 157 having the wire material wound therearound, and a first linear portion 158 and a second linear portion 159, which extend from both ends of the torsion spring 156 in different directions with each other at certain acute angles. An intermediate portion 160 is connected at a right angle to a distal end of the first linear portion 158 so as to form a U-shaped cross-section, and an extending portion 161 is connected at a right angle to a distal end of the intermediate portion 160. A hook 162 is formed at a distal end of the second linear portion 159.

Under a state in which the intermediate gear 151 is meshed with the first sector gear 143 and the second sector gear 149, the link arm 134 allows the through hole 134*a* on one end thereof to be rotatably fitted to the support shaft 148*a* of the fixing member 133, and the through hole 134*b* on another end thereof to be rotatably fitted to the support shaft 142*a* of the sheet pressing member 132. Similarly, the link arm 135 on the opposite side allows the through hole 135*a* on one side thereof to be rotatably fitted to the support shaft 148*b* of the fixing member 133, and the through hole 135*b* on another end to be rotatably fitted to the support shaft 142*b* of the sheet pressing member 132. With this, the sheet pressing member 132 is swingably mounted to and supported by the fixing member 133.

The coil portion 157 is externally fitted to the support shaft 148*b* of the fixing member 133 in a relatively loose manner from an outer side. The intermediate portion 160 is arranged to stride across the mounting portion 144 from the upstream in the carry-out direction so that parts of the first linear portion 158 and the extending portion 161 near the intermediate portion 160 are engaged with lower sides of the hook pieces 153*a* and 153*b* of the right and left surfaces of the mounting portion 144, respectively. Further, the hook 162 at the distal end of the second linear portion 159 is hooked to the cutout 152 of the link arm 135, which is externally fitted to the support shaft 148*b* from the outer side of the coil portion 157. Thus, the spring member 155 is mounted. With this, the link arm 135 is always urged in the clockwise direction in FIG. 12 and FIG. 13 about the support shaft 148*b*.

Figure 14A:
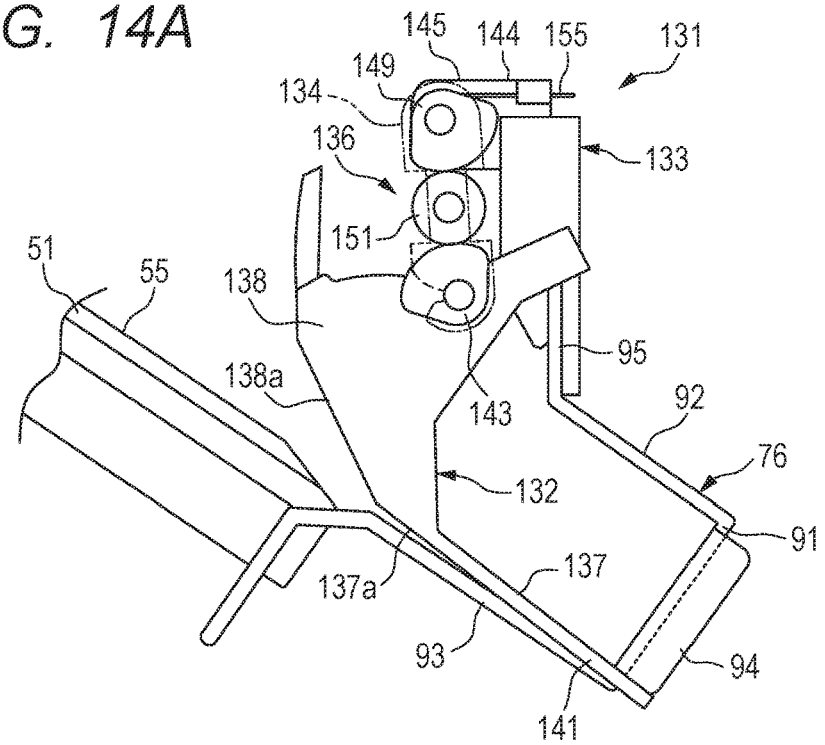
FIG. 14A is a side view of the sheet pressing unit of FIG. 12, which has a pressing member at a lowermost position.
Figure 14B:
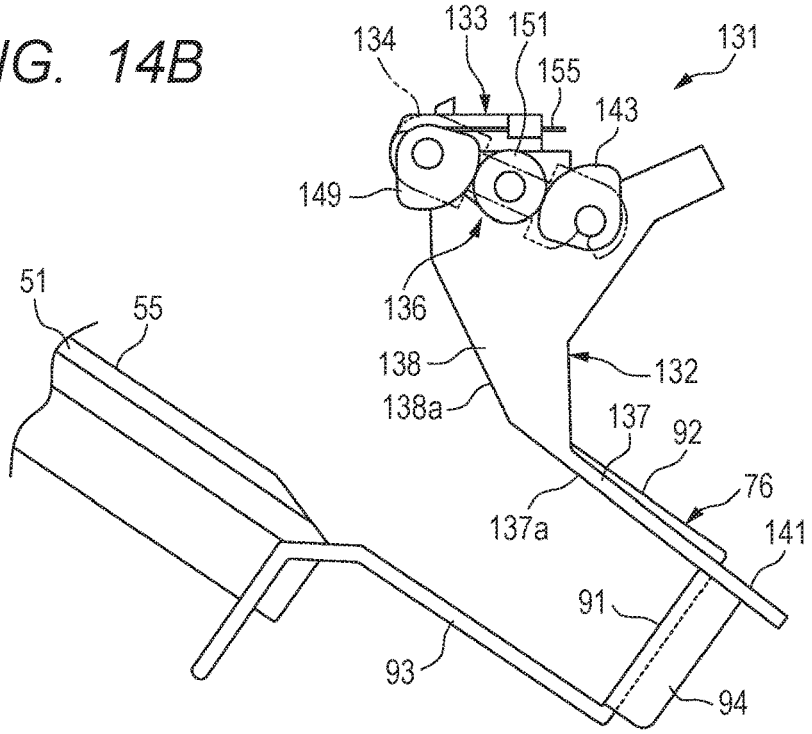
FIG. 14B is a side view of the sheet pressing unit of FIG. 12, which has the pressing member at an uppermost position.

As illustrated in FIG. 12, in the sheet pressing unit 131, the sheet pressing member 132 is arranged between the upper and lower flat plate portions 92 and 93 of the sheet trailing edge regulating member 76 to be mounted to the distal end 95. The sheet pressing member 132 is supported by the link arms 134 and 135 so as to be rotatable about the support shaft 148 in both directions between a lowermost position of FIG. 14A at which the pressing surface 137*a* is held in contact with the upper surface of the lower flat plate portion 93 and an uppermost position of FIG. 14B at which the sheet pressing member 132 comes into contact with the lower surface of the upper flat plate portion 92.

When the sheet pressing member 132 swings, the first sector gear 143 is rotated with respect to the second sector gear 149 through intermediation of the intermediate gear 151. At this state, through appropriate settings of dimensions, the number of teeth, and meshing positions of the intermediate gear 151, the first sector gear 143, and the second sector gear 149 of the gear mechanism 136, even in a case where the sheet pressing member 132 is at any swing positions, the pressing surface 137*a* can be always moved in parallel. Further, through appropriate settings of positions of the support shaft 142*a*, the support shaft 142*b*, and the support shaft 148, even in a case where the sheet pressing member 132 is at any swing positions, the pressing surface 137*a* can be set so as to always be kept substantially in parallel with respect to the upper surface of the lower flat plate portion 93, and to be moved to the upstream in the carry-out direction as ascending from the lowermost position of FIG. 14A to the uppermost position of FIG. 14B.

Other features of the sheet pressing unit 131 according to the second embodiment are the same as those of the sheet pressing unit 101 according to the first embodiment. Therefore, further detailed description of the sheet pressing unit 131 overlaps with that in the first embodiment, and thus is omitted.

Figure 15:
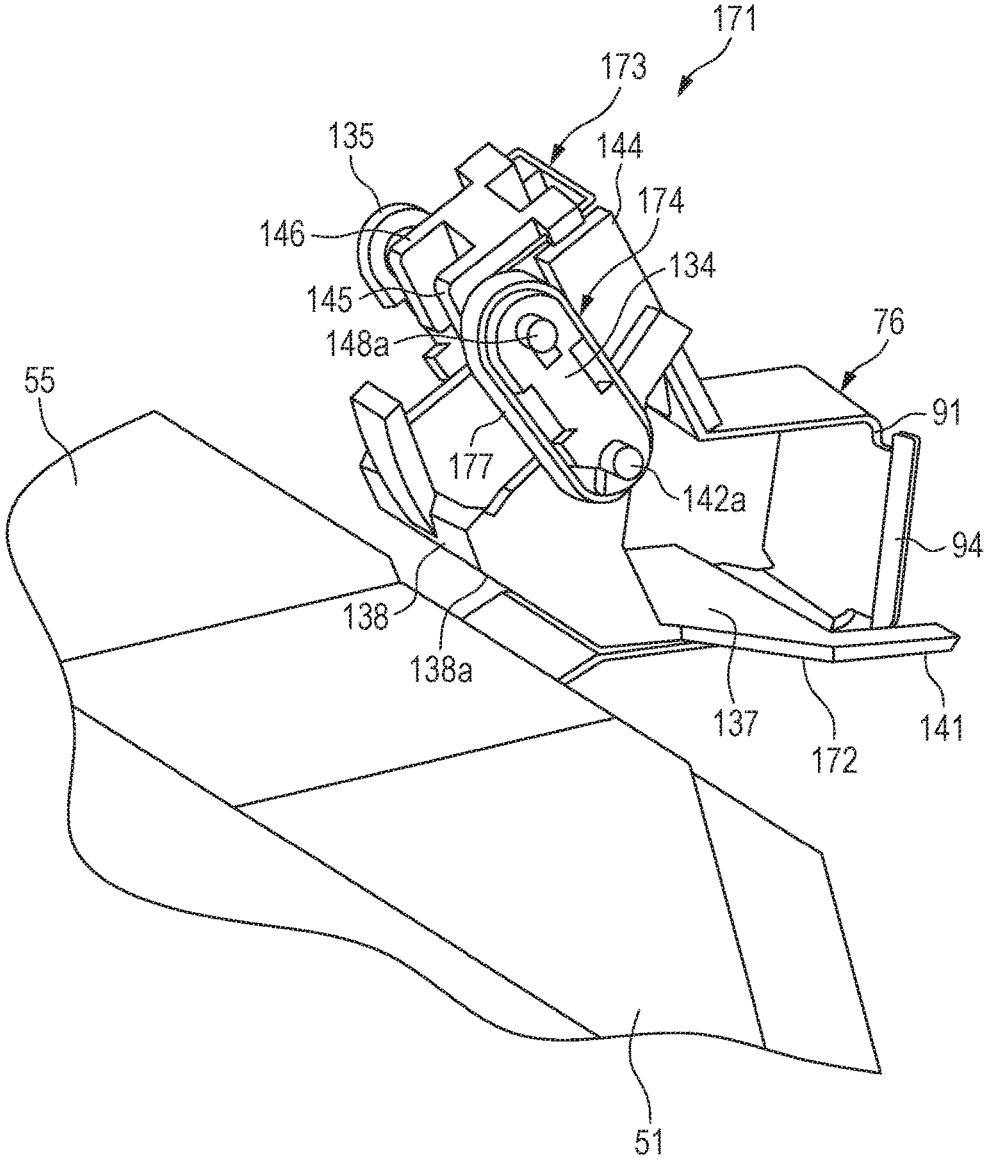
FIG. 15 is an enlarged perspective view of a sheet pressing unit according to a third embodiment of the present invention.
Figure 16:
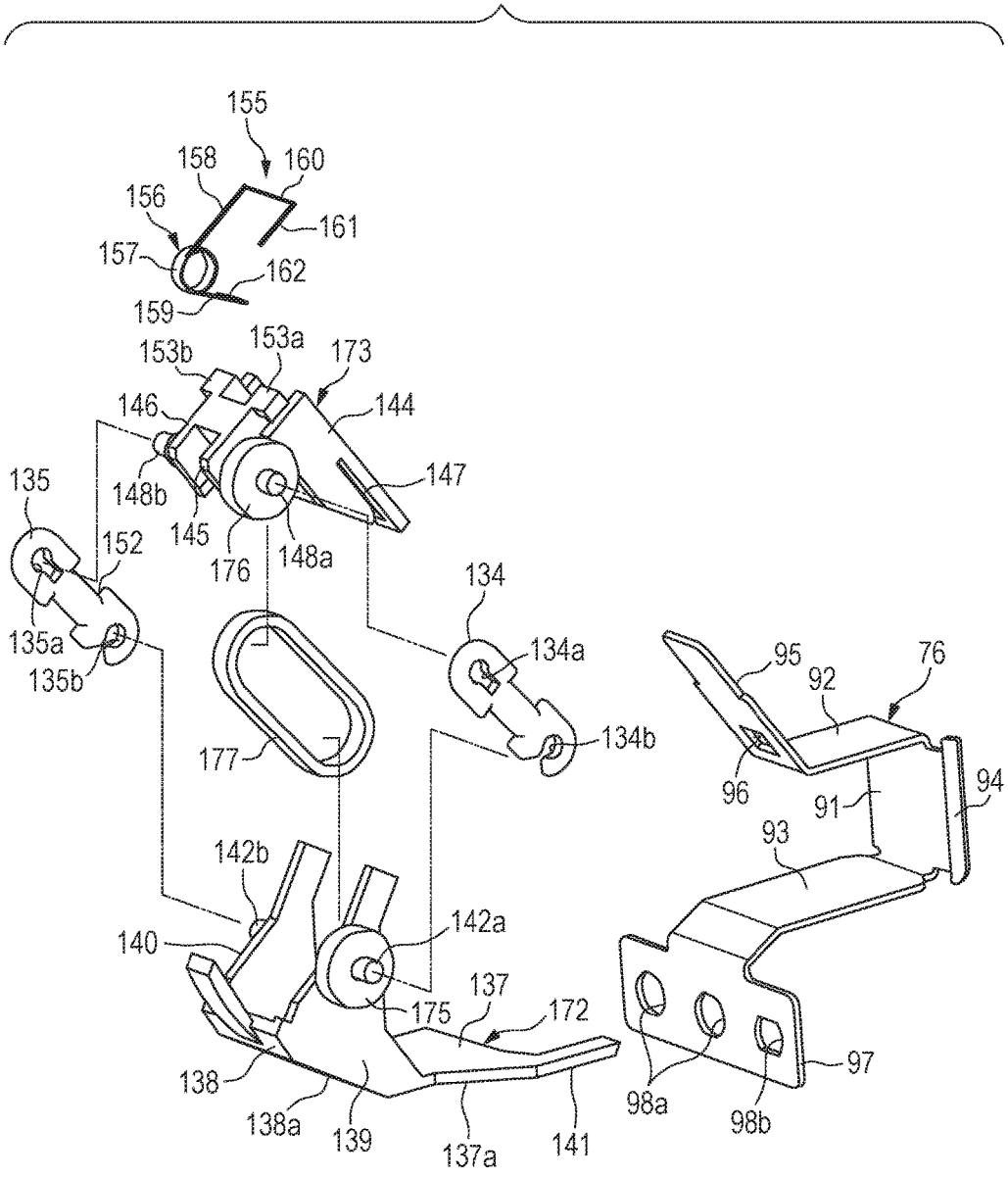
FIG. 16 is an exploded perspective view of the sheet pressing unit of FIG. 15.

FIG. 15 and FIG. 16 are illustrations of a sheet pressing unit 171 according to a third embodiment of the present invention. For each distal end of the two sheet trailing edge regulating members 76 on the carry-out direction side, which are bisymmetrically arranged along the upstream end of the processing tray 51 in the carry-out direction, the sheet pressing unit 171 is integrally and symmetrically mounted.

The sheet pressing unit 171 is a modified example of the second embodiment. The sheet pressing unit 171 includes a sheet pressing member 172 and a fixing member 173, which correspond to the sheet pressing member 132 and the fixing member 133, and the link arms 134 and 135 and the spring member 155, which are the same as those in the second embodiment. In the link arm 134 according to the present embodiment, the support shaft 150 according to the second embodiment is omitted. Further, the sheet pressing unit 171 has a transmission belt mechanism 174 in place of the gear mechanism 136 according to the second embodiment.

The sheet pressing member 172 is the same as the sheet pressing member 132 according to the second embodiment, except for that a first pulley 175 constructing a part of the transmission belt mechanism 174 is fixed to a base end of the support shaft 142*a* so as not to be rotatable. The fixing member 173 is the same as the fixing member 133 according to the second embodiment, except for that a second pulley 176 constructing a part of the transmission belt mechanism 174 is fixed to a base end of the support shaft 148*a* so as not to be rotatable. The transmission belt mechanism 174 further includes a transmission belt 177 wound around the first pulley 175 and the second pulley 176.

Under a state in which the transmission belt 177 is wound around the first pulley 175 and the second pulley 176 so as to be circumferentially movable in both directions, the link arm 134 allows the through hole 134*a* on one side thereof to be rotatably fitted to the support shaft 148*a* of the fixing member 173, and the through hole 134*b* on the other side thereof to be rotatably fitted to the support shaft 142*a* of the sheet pressing member 172. Similarly, the link arm 135 on another side allows the through hole 135*a* on one side thereof to be rotatably fitted to the support shaft 148*b* of the fixing member 173, and the through hole 135*b* on the other side thereof to be rotatably fitted to the support shaft 142*b* of the sheet pressing member 172. With this, the sheet pressing member 172 is swingably mounted to and supported by the fixing member 173. Similarly to the second embodiment, the spring member 155 is mounted so as to always urge the link arm 135 in the clockwise direction in FIG. 15 and FIG. 16 about the support shaft 148*b*.

Figure 17A:
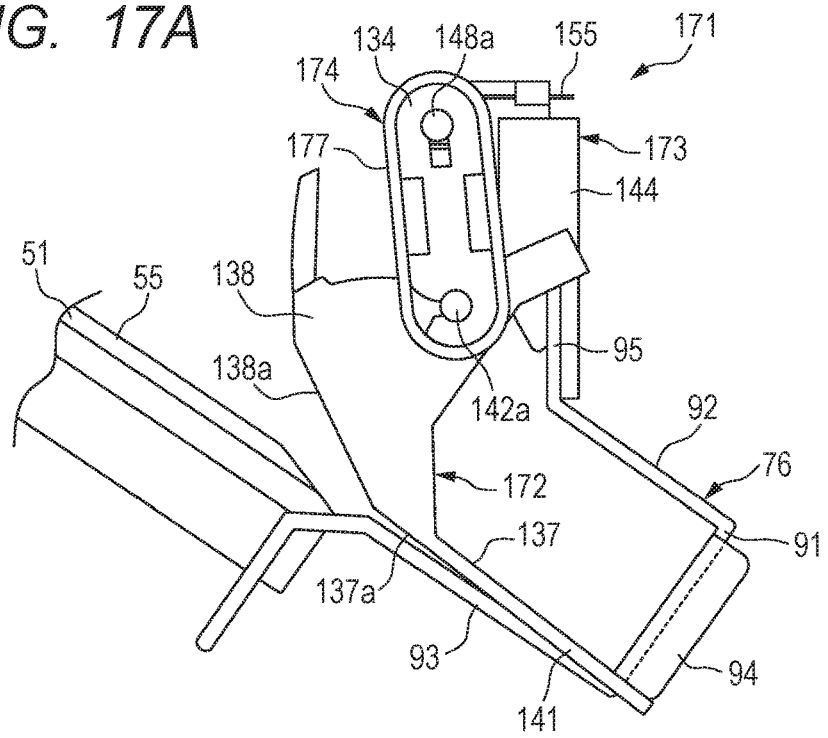
FIG. 17A is a side view of the sheet pressing unit of FIG. 15, which has a pressing member at a lowermost position.
Figure 17B:
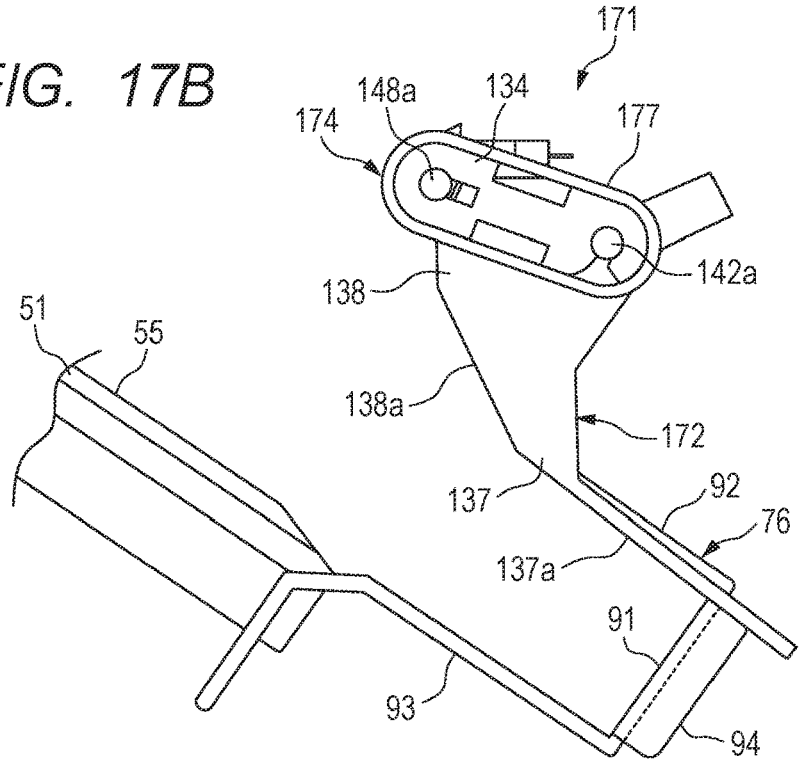
FIG. 17B is a side view of the sheet pressing unit of FIG. 15, which has the pressing member at an uppermost position.

As illustrated in FIG. 15, in the sheet pressing unit 171, the sheet pressing member 172 is arranged between the upper and lower flat plate portions 92 and 93 of the sheet trailing edge regulating member 76 to be mounted to the distal end 95. The sheet pressing member 172 is supported by the link arms 134 and 135 so as to be rotatable about the support shaft 148 in the both directions between a lowermost position of FIG. 17A at which the pressing surface 137*a* is held in contact with the upper surface of the lower flat plate portion 93 and an uppermost position of FIG. 17B at which the sheet pressing member 172 comes into contact with the lower surface of the upper flat plate portion 92.

When the sheet pressing member 172 swings, the transmission belt 177 is circumferentially moved between the first pulley 175 and the second pulley 176. At this state, through appropriate settings of a length of the transmission belt 177 and winding positions for the first pulley 175 and the second pulley 176, even in a case where the sheet pressing member 132 is at any swing positions, the pressing surface 137*a* can be always moved in parallel. Further, through appropriate settings of positions of the support shaft 142*a*, the support shaft 142*b*, and the support shaft 148, even in a case where the sheet pressing member 132 is at any swing positions, the pressing surface 137*a* can be set so as to always be kept substantially in parallel with respect to the upper surface of the lower flat plate portion 93, and to be moved to the upstream in the carry-out direction as ascending from the lowermost position of FIG. 17A to the uppermost position of FIG. 17B.

Other features of the sheet pressing unit 171 according to the third embodiment are the same as those of the sheet pressing unit 131 according to the second embodiment. Therefore, further detail description of the sheet pressing unit 171 overlaps with that in the second embodiment, and thus is omitted.

The sheet stacking apparatus according to the present invention can improve an alignment property of sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-029798, filed Feb. 19, 2016, which is hereby incorporated by reference herein in its entirety.

What is claimed is:

1. A sheet stacking apparatus, comprising:

a placement portion on which a sheet is placed;

a conveyance portion configured to convey a sheet placed on the placement portion;

a regulation portion configured to regulate a position of a sheet conveyed by the conveyance portion through contact with the sheet;

a pressing portion configured to press a sheet regulated in position by the regulation portion, the pressing portion being configured to press a sheet regulated in position by the regulation portion at a first pressing position and a second pressing position, the second pressing position being spaced apart from the placement portion in a thickness direction of a sheet placed on the placement portion by a distance which is longer than a distance between the placement portion and the first pressing position, the pressing portion being configured to press a sheet which is being conveyed by the conveyance portion and is not in contact with the regulation portion at the first pressing position, and the pressing portion being configured to press a sheet which is being conveyed by the conveyance portion and is not in contact with the regulation portion at the second pressing position; and a support member configured to support the pressing portion in a movable manner in the thickness direction and a conveyance direction in which the conveyance portion conveys a sheet, wherein an area of pressing a sheet at the first pressing position is larger than an area of pressing a sheet at the second pressing position, and wherein the support member includes four-bar connecting members constructing a parallel link mechanism.

2. A sheet stacking apparatus according to claim 1, wherein the support member is configured to keep a placing surface of the placement portion and the pressing portion to be substantially parallel to each other.

3. A sheet stacking apparatus according to claim 2, wherein the pressing portion is pushed by a sheet to be conveyed by the conveyance portion and moved in the thickness direction and the conveyance direction.

4. A sheet stacking apparatus according to claim 1, further comprising an elastic member configured to allow a pressing force of the pressing portion with respect to a sheet to be placed on the placement portion to increase as a height of sheets placed on the placement portion in the thickness direction increases.

5. A sheet stacking apparatus according to claim 4, wherein the pressing force of the pressing portion is set to a pressing force which allows a sheet, which is to be conveyed by the conveyance portion after a sheet placed on the placement portion, to be received between the sheet placed on the placement portion and the pressing portion.

6. A sheet stacking apparatus according to claim 1, further comprising:

a guide portion located at a position opposite to the regulation portion across the pressing portion in the conveyance direction in which the conveyance portion conveys a sheet and configured to guide a sheet to be conveyed to the regulation portion, the position of the guide portion varying according to a height of sheets placed on the placement portion in the thickness direction, a distance in the conveyance direction between the guide portion and the regulation portion decreasing as the height of sheets placed on the placement portion in the thickness direction increases.

7. A sheet stacking apparatus according to claim 6, wherein the pressing portion is movable integrally with the guide portion.

8. A sheet stacking apparatus according to claim 1, further comprising an elastic member configured to allow a pressing force of the pressing portion for a sheet to be placed on the placement portion to increase as a height of sheets placed on the placement portion in the thickness direction increases, wherein the elastic member urges at least one of the connecting members.

9. A sheet stacking apparatus according to claim 1, wherein the pressing portion comprises a plurality of pressing portions.

10. A sheet stacking apparatus according to claim 1, further comprising a binding portion configured to bind sheets regulated by the regulation portion.

11. A sheet stacking apparatus according to claim 10, wherein the binding portion is movable, and wherein a movement region of the pressing portion is set within a region without hindering movement of the binding portion.

12. An image forming system, comprising:

an image forming unit configured to form an image on a sheet; and a sheet stacking apparatus configured to stack a sheet on which the image is formed by the image forming system, the sheet stacking apparatus comprising the sheet stacking apparatus of claim 10.

13. A sheet stacking apparatus, comprising:

a placement portion on which a sheet is placed;

a conveyance portion configured to convey a sheet placed on the placement portion;

a regulation portion configured to regulate a position of a sheet conveyed by the conveyance portion through contact with the sheet;

a pressing portion configured to press a sheet regulated in position by the regulation portion, the pressing portion being configured to press a sheet regulated in position by the regulation portion at a pressing position, the pressing portion being configured to press a sheet which is being conveyed by the conveyance portion and is not in contact with the regulation portion at the pressing position; and a support member configured to support the pressing portion in a movable manner in a thickness direction of a sheet placed on the placement portion and a conveyance direction in which the conveyance portion conveys a sheet, wherein the support member includes four-bar connecting members constructing a parallel link mechanism.

14. A sheet stacking apparatus, comprising:

a placement portion on which a sheet is placed;

a conveyance portion configured to convey a sheet placed on the placement portion;

a regulation portion configured to regulate a position of a sheet conveyed by the conveyance portion through contact with the sheet;

a pressing member configured to press a sheet regulated in position by the regulation portion, the pressing member comprising a pressing portion and a guide portion, the pressing portion being configured to move integrally with the guide portion, the pressing portion being configured to press a sheet regulated in position by the regulation portion at a first pressing position and a second pressing position, the second pressing position being spaced apart from the placement portion in a thickness direction of a sheet placed on the placement portion by a distance which is longer than a distance between the placement portion and the first pressing position, the pressing portion being configured to press a sheet which is being conveyed by the conveyance portion and is not in contact with the regulation portion at the first pressing position, and the pressing portion being configured to press a sheet which is being conveyed by the conveyance portion and is not in contact with the regulation portion at the second pressing position, the guide portion being located at a position opposite to the regulation portion across the pressing portion in a conveyance direction in which the conveyance portion conveys a sheet and being configured to guide a sheet to be conveyed to the regulation portion; and a support member configured to support the pressing member such that a whole of the pressing member moves in the thickness direction and the conveyance direction, the pressing portion moving to a position corresponding to the first pressing position and a position corresponding to the second pressing position by being supported by the support member, the guide portion moving to a first position and a second position by being supported by the support member, the guide portion being positioned at the first position in a case that the pressing portion presses a sheet at the first pressing position, the guide portion being positioned at the second position in a case that the pressing portion presses a sheet at the second pressing position, a distance between the guide portion located at the first position and the regulation portion in the conveyance direction being longer than a distance between the guide portion located at the second position and the regulation portion in the conveyance direction.

15. A sheet stacking apparatus according to claim 14, wherein an area of pressing a sheet at the first pressing position is larger than an area of pressing a sheet at the second pressing position.

16. A sheet stacking apparatus, comprising:

a placement portion on which a sheet is placed;

a conveyance portion configured to convey a sheet placed on the placement portion;

a regulation portion configured to regulate a position of a sheet conveyed by the conveyance portion through contact with the sheet;

a pressing portion configured to press a sheet regulated in position by the regulation portion, the pressing portion being configured to press a sheet regulated in position by the regulation portion at a pressing position, the pressing portion being configured to press a sheet which is being conveyed by the conveyance portion and is not in contact with the regulation portion at the pressing position; and a support member configured to support the pressing portion in a movable manner in a thickness direction of a sheet placed on the placement portion and a conveyance direction in which the conveyance portion conveys a sheet, the support member being configured to be rotatable about a first axis and supporting the pressing portion such that the pressing portion rotates about a second axis different from the first axis.

17. A sheet stacking apparatus according to claim 16, wherein the pressing portion is configured to press a sheet regulated in position by the regulation portion at a first pressing position and a second pressing position, the second pressing position is spaced apart from the placement portion in a thickness direction of a sheet placed on the placement portion by a distance which is longer than a distance between the placement portion and the first pressing position, the pressing portion is configured to press a sheet which is being conveyed by the conveyance portion and is not in contact with the regulation portion at the first pressing position, and the pressing portion is configured to press a sheet which is being conveyed by the conveyance portion and is not in contact with the regulation portion at the second pressing position.

* * * * *